US006694778B2

(12) United States Patent
Kawabuchi et al.

(10) Patent No.: US 6,694,778 B2
(45) Date of Patent: Feb. 24, 2004

(54) CUT DESIGN OF DIAMOND FOR ORNAMENTAL USE

(75) Inventors: Yoshinori Kawabuchi, Yokohama (JP); Tamotsu Matsumura, Ayase (JP)

(73) Assignee: Hohoemi Brains, Inc., Osaka (JP)

( * ) Notice: Subject to any disclaimer, the term of this patent is extended or adjusted under 35 U.S.C. 154(b) by 21 days.

(21) Appl. No.: 09/879,750

(22) Filed: Jun. 12, 2001

(65) Prior Publication Data

US 2002/0043078 A1 Apr. 18, 2002

(30) Foreign Application Priority Data

Aug. 25, 2000 (JP) ..... 2000-255039
Feb. 26, 2001 (JP) ..... 2001-049636

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS 2,364,031 A * 11/1944 Suderov ..... 63/32
3,286,486 A * 11/1966 Huisman et al. ..... 63/32
3,585,764 A * 6/1971 Huisman et al. ..... 451/58
3,665,729 A * 5/1972 Elbe ..... 63/32
3,788,097 A * 1/1974 Elbe ..... 63/32
4,083,352 A * 4/1978 Andrychuk ..... 63/32
4,306,427 A * 12/1981 Urban ..... 63/32
5,462,474 A * 10/1995 Hansen ..... 451/41
5,612,102 A * 3/1997 Nakama ..... 428/15
D383,998 S * 9/1997 Condron ..... D11/40
6,029,474 A * 2/2000 Bunz ..... 63/32
D451,427 S * 12/2001 Tolkowsky ..... D11/90
6,397,832 B1 * 6/2002 Shuto ..... 125/30.01
6,422,039 B2 * 7/2002 Bamminger et al. ..... 63/32

FOREIGN PATENT DOCUMENTS

DE 297 14 058 11/1997
JP 2001204519 7/2001

* cited by examiner

*Primary Examiner*—Andrea Chop
(74) *Attorney, Agent, or Firm*—McGlew and Tuttle, P.C.

(57) ABSTRACT

A cut design for diamonds having a crown of substantially a frustum shape and substantially a conic pavilion directly under the frustum part, the diamond being enhanced in the brilliancy and scintillation of its crown part, the brilliancy and scintillation twinkling, and bluish lights being returned as reflected lights. A crown angle c and a pavilion angle p are so determined that lights coming in crown facets and emitted from crown facets, lights coming in the table facet and emitted from the crown facets, and lights coming in the crown facets and emitted from the table facet be directed toward the observer at the same time. Further, it is preferable to determine the crown angle c and the pavilion angle p so that the angles formed by incident lights and emitted lights are substantially equal to each other. Its table diameter should be between or equal to 0.60 and 0.33, more preferably not more than 0.55 and even more preferably not more than 0.38, in its ratio to the girdle diameter.

28 Claims, 19 Drawing Sheets

INTENSITY RATIO OF REFLECTED LIGHT TO INCIDENT LIGHT
WITH DIAMOND OF CROWN ANGLE c:27.9°, PAVILION ANGLE p:38.5°,
TABLE DIAMETER:0.5 AND Gd:0.33,
USING 550 NM LIGHT

INTENSITY RATIO OF REFLECTED LIGHT TO INCIDENT LIGHT
WITH DIAMOND OF CROWN ANGLE c:27.9°, PAVILION ANGLE p:38.5°,
TABLE DIAMETER:0.5 AND Gd:0.16,
USING 550 NM LIGHT

INTENSITY RATIO OF REFLECTED LIGHT TO INCIDENT LIGHT
WITH DIAMOND OF CROWN ANGLE c:27.9°, PAVILION ANGLE p:38.5°,
TABLE DIAMETER:0.38 AND Gd:0.16,
USING 550 NM LIGHT

INTENSITY RATIO OF REFLECTED LIGHT TO INCIDENT LIGHT
WITH DIAMOND OF CROWN ANGLE c:34.5°, PAVILION ANGLE p:40.75°,
TABLE DIAMETER:0.53 AND Gd:0.314,
USING 550 NM LIGHT

EMISSION ANGLE DIFFERENCES IN DEGREES OF REFLECTED LIGHTS
BETWEEN RED (686.4NM) AND BLUE (430.8NM)
WITH DIAMOND OF CROWN ANGLE c:27.9°, PAVILION ANGLE p:38.5°,
TABLE DIAMETER:0.5 AND Gd:0.33

EMISSION ANGLE DIFFERENCES IN DEGREES OF REFLECTED LIGHTS
BETWEEN RED (686.4NM) AND BLUE (430.8NM)
WITH DIAMOND OF CROWN ANGLE c:27.9°, PAVILION ANGLE p:38.5°,
TABLE DIAMETER:0.5 AND Gd:0.16

EMISSION ANGLE DIFFERENCES IN DEGREES OF REFLECTED LIGHTS
BETWEEN RED (686.4NM) AND BLUE (430.8NM)
WITH DIAMOND OF CROWN ANGLE c:27.9°, PAVILION ANGLE p:38.5°,
TABLE DIAMETER:0.38 AND Gd:0.16

EMISSION ANGLE DIFFERENCES IN DEGREES OF REFLECTED LIGHTS
BETWEEN RED (686.4NM) AND BLUE (430.8NM)
WITH DIAMOND OF CROWN ANGLE c:34.5°, PAVILION ANGLE p:40.75°,
TABLE DIAMETER:0.53 AND Gd:0.314

CUT DESIGN OF DIAMOND FOR ORNAMENTAL USE

BACKGROUND OF THE INVENTION

1. Field of the Invention

The present invention relates to a cut design of diamonds and jewelry, and more particularly to a novel cut design capable of providing diamonds and jewelry with brilliancy and scintillation excelling in both quality and quantity over conventional cut designs.

2. Description of the Related Art

In order to provide brilliant diamonds and jewelry by cutting diamonds for use in ornaments, diamonds for ornamental use in the brilliant cut having 58 facets each and jewelry using such diamonds have been obtained.

Four criteria used in evaluating diamonds, commonly known as 4C's, are as follows:

1. Carat (unit of weight);
2. Color;
3. Cut (proportion, symmetry and polish);
4. Clarity (quality and quantity of inclusions).

Regarding the weight expressed in carats, the value of a diamond has traditionally been determined by the size, which is measured by the weight. The color depends on the gemstone; colorless and transparent stones are scarce and highly valued. The Gemological Institute of America (GIA) assigns D, E and F grades to colorless and transparent diamonds, and incidentally yellowish, if only slightly, ones are graded K or even lower. Cut design gives brilliancy and scintillation to a gem. The relative clarity, determined by inherent impurities and/or flaws, is also determined at the raw stone stage.

Since the color and clarity are intrinsic to the gemstone, the only factor permitting artifice is the cut design, which determines brilliancy and scintillation. Therefore, studies have been continued to find cut designs which can enhance these attributes.

Mathematician Tolkowsky proposed what is known as the GIA system of cut design to increase the brilliancy and scintillation of diamonds. The ideal cut according to the GIA system has a pavilion angle of 40.75 degrees, a crown angle of 34.50 degrees and a table diameter corresponding to 53% of the girdle diameter. Essentially, a cut should be evaluated according to its contribution to beauty, but more importance tends to be attached to the yield from the gemstone.

SUMMARY OF THE INVENTION

An object of the present invention is to provide a cut design which can further enhance the brilliancy and scintillation of diamonds.

Another object of the invention is to provide a cut design which, when a diamond so cut is radiated from a specific direction, results in extremely enhanced brilliancy and scintillation, the diamond in that cut design, when observed under light, permitting perception of the relative degree of its brilliancy and scintillation by the twinkling of the reflected light.

Still another object of the invention is to provide a cut design having a spectral effect, capable of causing lights coming into a diamond to separate into its spectral components in the diamond and to reflect bluish lights from table facets and crown facets.

Since the upper portion of a cut diamond from the girdle level is usually extruded over its setting and exposed to the illumination, directions of the emerging lights from the table facet and crown facets (including star facets, main facets and upper girdle facets) have important meaning among the lights derived from the incident ones on the table and crown facets. As a result of examining the directions of emerging lights, it has been found that lights emerging from crown facets are originated from incident lights both on the table facet and crown facets and lights emerging from the table facet are from the crown facets. The invention has been made from this discovery.

A cut design of diamonds for ornamental use according to the invention has a crown portion above and a pavilion portion underneath, permitting simultaneous observation of lights coming into crown facets and emitted from crown facets, lights coming into the table facet and emitted from crown facets, and lights coming into crown facets and emitted from the table facet, when viewed above the table facet of the diamond. To realize this feature, in the cut design according to the invention, the pavilion angle p ranges from 45 degrees to 37.5 degrees, and the crown angle c in degrees is within a range of satisfying the following equation:

$$-3.5\times p+163.6\geqq c\geqq -3.8333\times p+174.232.$$

The cut design of diamonds for ornamental use according to the invention comprises a crown having substantially a frustum shape and substantially a conic pavilion below the frustum portion. When the pavilion angle p ranges from 45 degrees to 37.5 degrees, and the crown angle c in degrees satisfies the following equation:

$$-3.5\times p+163.6\geqq c\geqq -3.8333\times p+174.232,$$

the cut design results that the angles between an incident light and an emitted light are substantially equal to each other among lights coming in the crown facets and emitted from crown facets, lights coming in the table facet and emitted from the crown facets, and lights coming in the crown facets and emitted from the table facet.

The diameter of the table facet in cut design of diamonds for ornamental use according to the invention is from 0.60 to 0.33 in its ratio to the diameter of the girdle, and more preferably should be between or equal to 0.55 and 0.38.

In the foregoing dimensional feature, it is preferable for the pavilion angle p to be between or equal to 45 degrees and 37.5 degrees and for the crown angle c in degrees to be within a range of satisfying the following equation:

$$-3.75427\times p+172.8166\geqq c\geqq -3.74167\times p+171.4883.$$

In order to make three focal angles coincide with each other in the wavelength range from violet lights to dark blue lights and to strengthen reflected bluish lights, it is preferable that the crown angle c in degrees is within a range of satisfying the equation of $-3.7239\times p+171.4315\geqq c\geqq -3.74167\times p+171.4883$. It is further preferable for the pavilion angle p to be not greater than 40 degrees.

In the cut design of diamonds for ornamental use according to the invention, the projection Gd (expressed in the ratio to the radius of girdle) of the distance from the central axis of the diamond to the culet side apex of lower girdle facets in the pavilion onto a plane, passing the girdle side apex of main facets in the pavilion and the central axis of the diamond, advisably should be not more than about 0.3. More preferably, it should be not more than 0.25, and a particularly preferable Gd value is around 0.2.

A diamond of a cut design having a pavilion angle and a crown angle conforming to the present invention has more powerful reflected light rays than any conventional cut design, and shines brilliantly as a whole. Furthermore, by reducing the table facet size and expanding the crown facet size, reflected lights from crown facets and incident lights on crown facets can be more effectively utilized, resulting in more effective diamonds for ornamental use.

When the angles between an incident light and an emitted light are substantially equal to each other among lights coming in the crown facets and emitted from the crown facets, lights coming in the table facet and emitted from the crown facets, and lights coming in the crown facets and emitted from the table facet, the reflected lights provide in intermittent shinning and diminishing directions. For this reason, as the direction of observation or the inclination of an axis of the diamond (the axis normal to the table facet) is varied while irradiating the diamond with light, angles at which reflected lights are powerful and angles at which reflected lights are weak bring about intermittently twinkling, and different intensities of brilliancy and scintillation are observed. This feature, together with powerful reflected lights, accentuates the brilliancy and scintillation of the diamond.

Furthermore, as the patterns of lights coming in and reflected by the diamond are finer, the glitter can be intensified. It is also made possible to separate the lights coming in the diamond into its spectral components, enabling the color quality of the diamond to be controlled. While diamonds are usually observed under white light, a diamond of a cut design according to the invention is stronger in the property to transmit red lights through its pavilion facets and reflect blue lights, reflected lights from the table facet and crown facets have a greater blue component. This spectral performance can be controlled by varying the pavilion angle and the crown angle. Or if the pavilion angle and the crown angle are so set as to generate reflection of red lights with longer wavelength, red reflection will arise together with blue reflection, and accordingly the spectra of incident lights will be visible in the reflected lights, resulting in an unprecedented harmony of the full spectra of colors from red to violet and consequent colorific beauty.

DESCRIPTION OF THE PREFERRED EMBODIMENTS

Figure 1A:
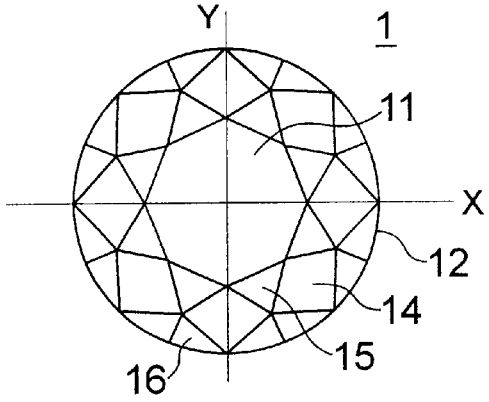
FIG. 1 shows an external appearance of a cut design of a diamond according to the present invention, FIG. 1A being a plane view showing an external appearance of a cut design of a diamond according to the present invention, FIG. 1B a side view showing an external appearance of a cut design of a diamond according to the present invention, and FIG. 1C a bottom view showing an external appearance of a cut design of a diamond according to the present invention.
Figure 1B:
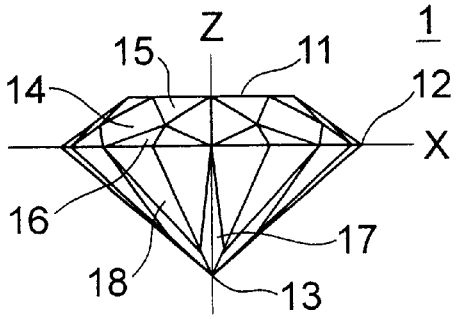
Figure 1C:
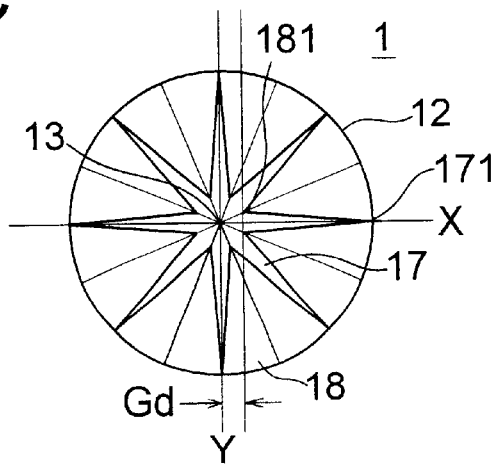
Figure 2:
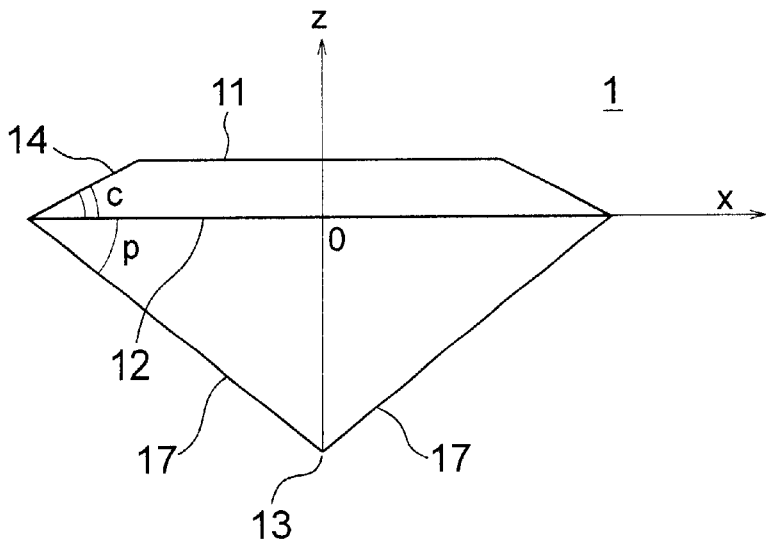
FIG. 2 shows a section of the cut design of the diamond according to the invention.

An external appearance of a cut design of a diamond 1 according to the present invention is shown in FIG. 1, and its section is shown in FIG. 2. FIG. 1A is a plane view; FIG. 1B, a profile; and FIG. 1C, a bottom view. Herein the top is a table facet 11, the portion above a girdle 12 is a crown having substantially a frustum shape with the table facet constituting the top facet of the frustum. The portion below the girdle 12 is a pavilion having substantially a conic pavilion, at the apex of which is a portion known as a culet 13. On the circumference of the crown, there are usually eight main facets 14; star facets 15 are formed between the circumference of the table and the main facets; and upper girdle facets 16 are formed between the girdle 12 and the main facets 14. On the circumference of the pavilion, usually eight main facets 17 are formed, and lower girdle facets 18 are formed between the girdle and the main facets.

In FIG. 2 which shows a sectional view, the same constituent parts are assigned respectively the same reference numerals as in FIG. 1. Here, the angle formed by the main facets 14 of the crown with a horizontal section (XY plane) of the girdle, i.e. the crown angle, is denoted by c, while the angle formed by the main facets 17 of the pavilion with the horizontal section (XY plane) of the girdle, i.e. the pavilion angle, is denoted by p. Hereinafter in this specification, the main facets, the star facets and the upper girdle facets in the crown may be collectively referred to as the crown facets, and the main facets and the lower girdle facets in the pavilion, as the pavilion facets. For the convenience of description, as shown in FIG. 2, coordinate axes (of a right-handed system) are supposed in the diamond, of which the z axis stands upward from the center of the table facet, and its origin 0 is placed at the center of the girdle. Incidentally, the y-axis is not shown here because it is directed toward the back side of the paper from the origin 0.

For this specification, optical paths were studied in the following procedure.

(1) The diamond was supposed to be symmetrical around the z-axis at every 45 degrees, and every 45 degrees segment, to be symmetrical with respect to a plane (e.g. the zx-plane). The starting points of inward and outward optical paths were considered in a region of half of this segment, i.e. a 22.5 degrees region. For instance, to look for the destination (emission point) and optical path of a light coming in a certain point at a certain angle, incident lights from points in this 22.5 degrees region were traced. The whole optical paths could be easily estimated from the symmetry.

(2) In tracing optical paths, each light ray was represented by a vector having starting point coordinates (Xi, Yi, Zi) and directional unit vector (l, m, n), and each facet of the diamond, by a vector having known point coordinates (a, b, c) on the plane and its normal unit vector (u, v, w) to the plane. A diamond cut in this way had, in a 45 degrees region, a total of eight faces comprising the table facet, the crown main facet, two upper girdle facets, the star facet, the pavilion main facet and two lower girdle facets, and seven more sets of these facets when turned by 45 degrees at a time. The outer surface of the girdle was disregarded here, because it was a cylindrical face and had little influences with a tinny height.

(3) Optical paths, angles of emission, points of emission, reflection and refraction (angles of intersection between light rays and planes) were determined by vector calculation.

Thus, points of reflection, refraction and emission were calculated as points of intersection between these lines and planes (solutions to simultaneous equations).

Equation for lines: $(x-Xi)/l=(y-Yi)/m=(z-Zi)/n$

Equation for planes: $u(x-a)+v(y-b)+w(z-c)=0$

The points of intersection were calculated as solutions of these simultaneous equations, and the points of intersection with each plane were sequently and consistently calculated so as to obtain a right solution satisfying the conditions.

Directional changes (vectors after directional change) of optical paths upon incidence and refraction were calculated with the refraction index and synthetic vectors which were constituted of the vectors of incident light and of planar direction. Calculation was done in the same way for reflection, though the form of synthetic vectors was different. Light rays after directional change were represented by lines having these points of intersection as starting points.

Angles formed by planes and light rays were calculated as scalar products of the normal vectors of facets and the directional vectors of light rays, and where such an angle was smaller than a critical angle, emission took place as refraction, while reflection occured where it was greater. For each case of reflection, the point of intersection between the light ray and the plane after the directional change was figured out anew, and the same calculation was performed.

(4) These optical path calculations were applied as appropriate both to the line of gaze (tracing from the observing side to the source of light) and to the light ray (from the light source to the point of observation). Thus the tracing of the optical path from the emitting side to the light source and that of the optical path from the light source side to the emitting point were calculated based on the same principle.

(5) Incident white light was separated into the spectrum during multiple reflections in the diamond and red component emerges from facets when it came to the facets at an angle less than the critical angle, while blue remained in the diamond. For the destinations of the blue components the optical paths were figured by the above-described method.

In defining the size of a diamond, besides the diameter of the table or its ratio to the diameter of the girdle (in %), the crown height, pavilion depth or total depth is sometimes used, but they can be calculated, once the table diameter, pavilion angle p and crown angle c are determined, and therefore they will not be discussed in this specification.

Figure 3:
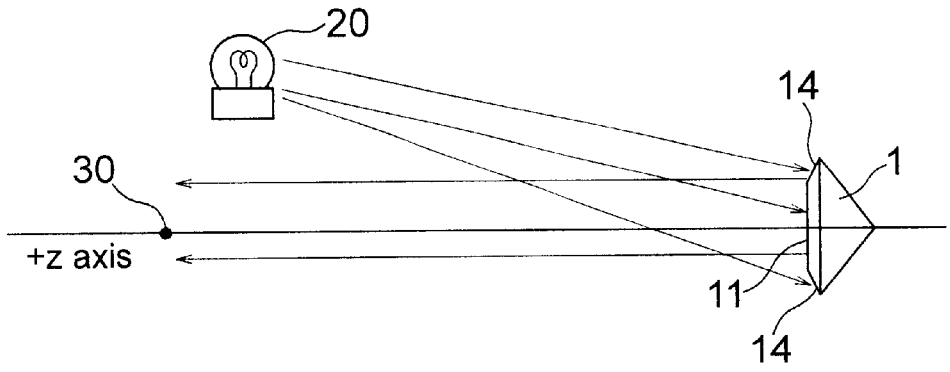
FIG. 3 is a diagram illustrating how a diamond cut according to the invention is observed.

A diamond, set in as jewelry, is usually observed from the side of the table facet. As shown in FIG. 3 an observer 30, who is at a certain distance (from 250 to 300 mm) from the table facet 11 on the z axis (center line) vertical to the table facet, perceives the reflected lights from the diamond, including lights having entered through the table facet 11 and emitted from the crown facets 14 (which may be referred to as "t-to-c lights" hereinafter), lights having entered through the crown facets 14 and emitted from the table facet 11 (which may be referred to as "c-to-t lights" hereinafter), lights having entered through the crown facets 14 and emitted from the crown facets 14 (which may be referred to as "c-to-c lights" hereinafter), and lights having entered through the table facet 11 and emitted from the table facet 11 (which may be referred to as "t-to-t lights" hereinafter).

In order for the observer to perceive the brilliancy and scintillation of a diamond, the rays of lights reflected in the diamond should reach the observer. The position of intersection of the axis of incidence (light source) and the axis of emission shall be called the "focal point" and the angle of their intersection shall be defined in this specification to be the "focal angle". If the differences in focal angle among a c-to-t light, a t-to-c light and a c-to-c light are within a certain range, these three reflected lights reach the observer at the same time. When the differences among the three reflected lights in focal angle are not more than about 7.4 degrees, the three reflected lights are visible to the observer under any size of light sources. It has been found that, when any two or more of the focal angles are made equal to each other, the highest level of brilliancy and scintillation can be achieved. The t-to-t light here is extremely little, and accordingly can be ignored.

The cut design of a diamond according to the present invention has three focal points: the one of c-to-t light, the one of t-to-c light and the one of c-to-c light. When cut-designed so that the focal point of t-to-c light is on the back side of the diamond as a convex mirror (the focal angle then is expressed with a plus sign), a focal angle of the c-to-c light exists, and its focal point is on the front side as in a concave mirror. When the focal point of c-to-t light and t-to-c light is on the back side of the diamond, thus in the −z direction, by analogy with a convex mirror, it is understood that lights having come in various directions on the table facet 11 and the crown facets 14 of the diamond 1 have reached the observer 30 in front of the table facet 11.

Figure 4:
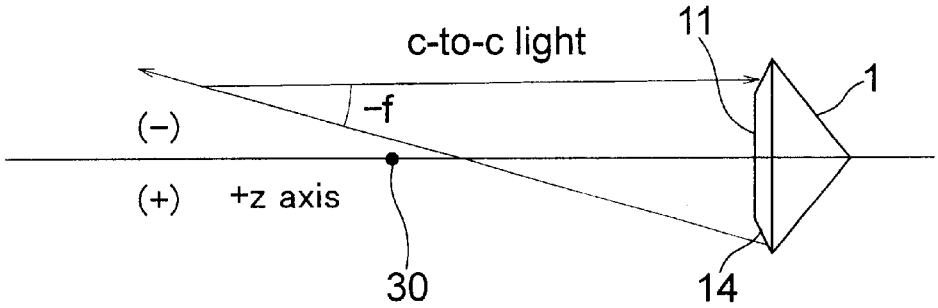
FIG. 4 is a diagram illustrating a c-to-c reflected light.
Figure 5:
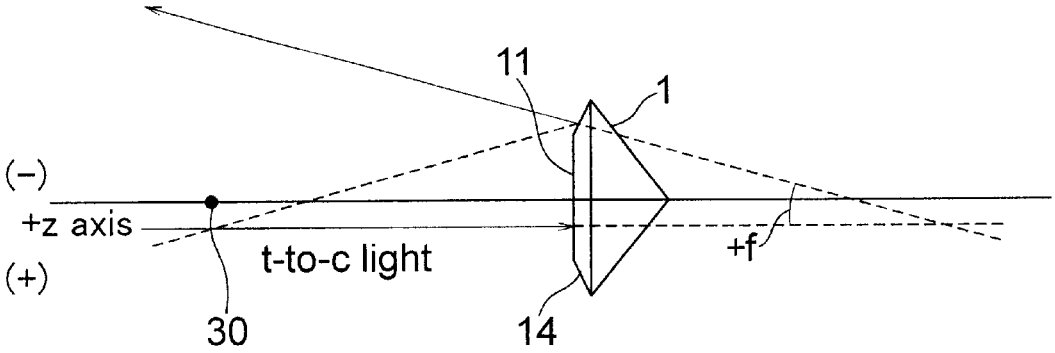
FIG. 5 is a diagram illustrating a t-to-c reflected light.
Figure 6:
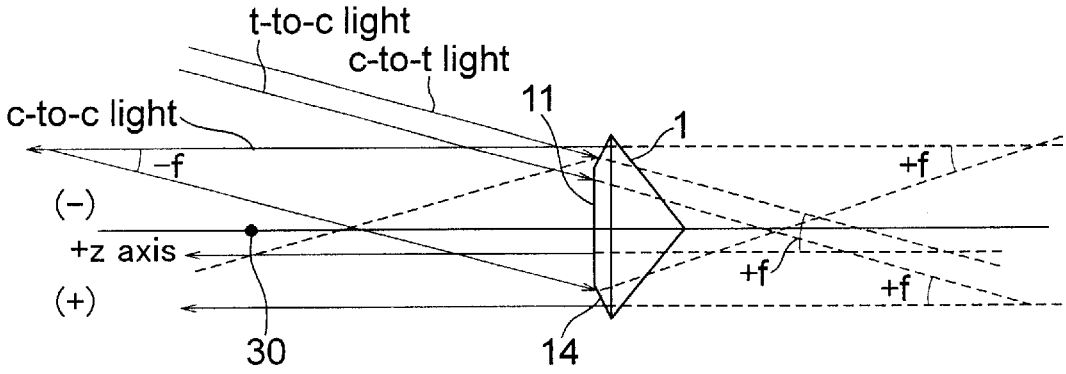
FIG. 6 is a diagram explaining three focal angles.

According to the invention, in the cut design above mentioned, the c-to-c lights also reach the observer 30, as their focal angle become negative (−f) and as a result the lights focus in front of the table facet 11 (on the observer side) as shown in FIG. 4. Thus, as shown in FIG. 3, when a light source 20 of a certain size is placed in front of the table facet of the diamond 1, lights coming into some of the crown facets 14 (upper crown facets in FIG. 3) out of the lights from the light source 20 travel on the optical path of FIG. 5 in the reverse direction and are emitted from the table facet 11 to reach the observer 30 in front of the table facet 11. At the same time, lights coming into other crown facets 14 (lower crown facets in FIG. 3) out of the lights from the light source 20 travel on the optical path in FIG. 4 in the reverse direction and are emitted from upper ones of the crown facets 14 to reach the observer 30 in front of the table facet 11 similarly. Since the diameter, i.e. the girdle diameter, of a diamond of even one carat is only 6.25 mm, if the absolute value of the focal angle (+f) of the t-to-c light in FIG. 5 and that of the focal angle of the c-to-c light in FIG. 4 are equal, the t-to-c light, c-to-t light and c-to-c light reflected by the diamond 1 become parallel and travel toward the observer 30, who perceive these lights together and sense further intensified brilliancy and scintillation of the reflected lights. FIG. 6 illustrates how this occurs. As the t-to-c light, c-to-t light and c-to-c light reach the observer 30 together, the diamond 1 looks excellent in brilliancy and scintillation.

Presence of c-to-c Lights, t-to-c Lights and c-to-t Lights

Using a diamond having a pavilion angle p of 38 degrees, a crown angle c of 29.5 degrees and a table facet diameter t of 0.38 (in the ratio to the girdle diameter) as an embodiment of the present invention, lights were brought to incidence on its crown facets and table facet in many different directions, ranging from a direction substantially parallel to each facet to a direction at a right angle to the z axis. FIGS. 7 through 11 illustrates how they are emitted.

Figure 7:
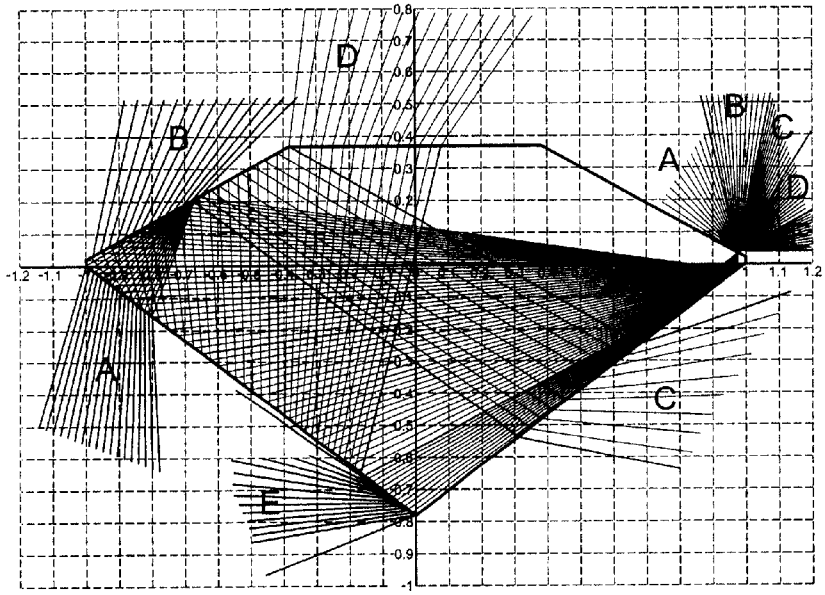
FIG. 7 is a diagram illustrating optical paths of lights coming in crown facets.

FIG. 7 shows the optical paths of lights coming in a position of 0.98 in the ratio to the girdle radius on crown facets in the direction of the −z axis. Of these lights, lights A have come in a range from a direction substantially parallel to crown facets to a direction at an angle of −12 degrees to the z axis. They are reflected by pavilion facets, reach crown facets on the other side, are reflected there, reach pavilion facets on the other side, and are transmitted there to be emitted from the bottom side of the diamond. Lights B have come in a range of directions at angles of −12 degrees to +10 degrees to the z axis. They are reflected by pavilion facets, reach pavilion facets on the other side, are reflected there, and are transmitted around crown facets on the other side to be emitted from the upper side of the diamond. Lights C have come in a range of directions at angles of +10 degrees to +32 degrees to the z axis. They are reflected by pavilion facets, reach pavilion facets on the other side, are reflected there, reach crown facets on the other side, reflected there to the pavilion facets they have come from, and are transmitted there to be emitted from the bottom side of the diamond. Lights D have come in a range of directions at angles of +32 degrees to +60 degrees to the z axis. They are reflected by pavilion facets, reach pavilion facets on the other side, are reflected there, and are transmitted by the table facet to be emitted from the upper side of the diamond. Lights E have come in a range of directions at angles of +60 degrees to 90 degrees to the z axis. They are reflected by pavilion facets, reach pavilion facets on the other side, and are transmitted there to be emitted from the upper side of the diamond.

Figure 8:
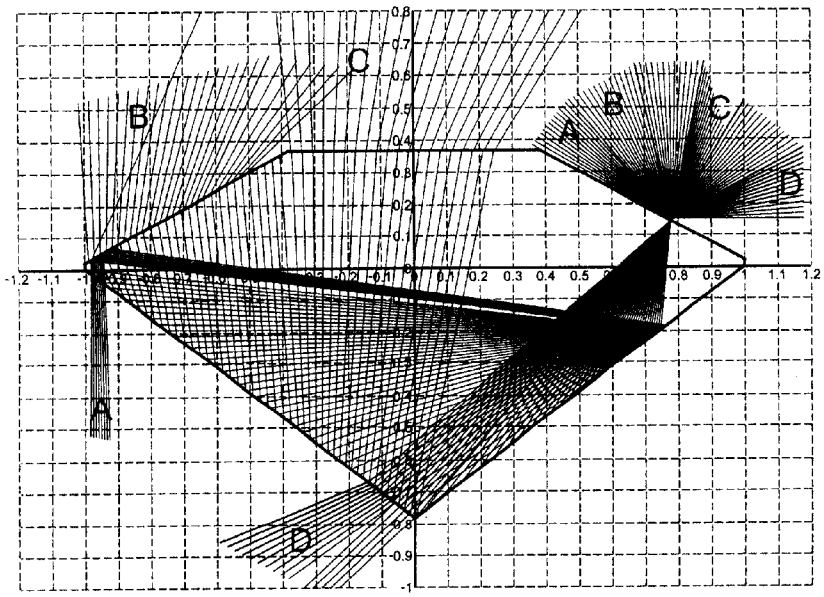
FIG. 8 is another diagram illustrating optical paths of lights coming in crown facets.

FIG. 8 shows the optical paths of lights coming in a position of 0.8 in the ratio to the girdle radius on crown facets in the direction of the −z axis. Of these lights, lights A have come in a range from a direction substantially parallel to a crown facet to a direction at an angle of −38 degrees to the z axis. They are reflected by pavilion facets, reach crown facets on the other side, are reflected there, reach pavilion facets on the other side, and are emitted from the bottom side of the diamond. Lights B and C have come in a range of directions at angles of −38 degrees to +58 degrees to the z axis. They are reflected by pavilion facets, reach pavilion facets on the other side, are reflected there, reach crown facets on the other side and the table facet, and are emitted from the upper side of the diamond. Of these lights, lights B have come in a range of directions at angles of −38 degrees to the z axis to the direction of the z axis. All these lights are emitted from crown facets on the other side. Lights C have come in a range of directions from the direction of the −z axis to a direction of +58 degrees to the z axis. They are emitted from a range from upper crown facets to the table facet. Lights of D have come in a range of directions at angles of +58 degrees to 90 degrees to the z axis. They all directly reach pavilion facets on the other side, and are transmitted there to be emitted from the bottom side of the diamond.

Figure 9:
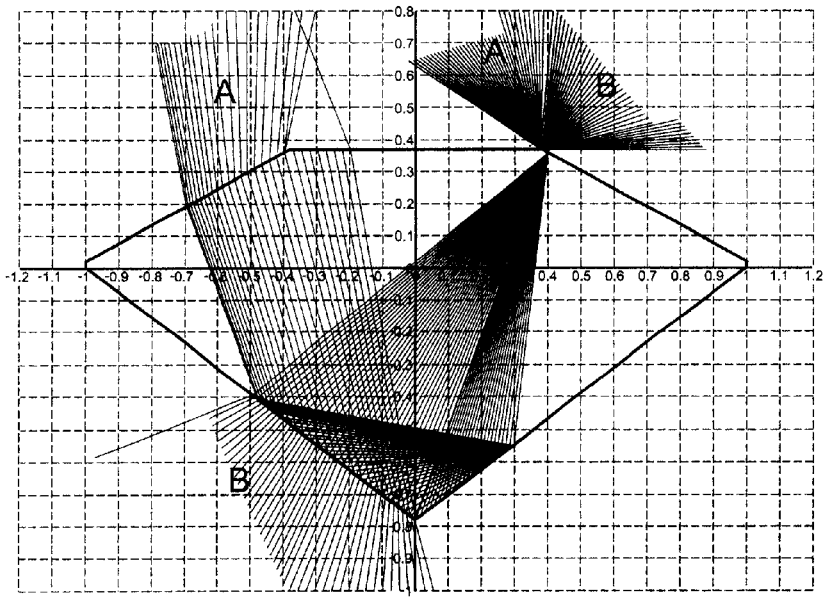
FIG. 9 is still another diagram illustrating optical paths of lights coming in crown facets.

FIG. 9 shows the optical paths of lights coming in a position near the table of the crown facets, i.e. in a position of 0.4 in the ratio to the girdle radius, in the direction of the −z axis. Lights A have come in a range from a direction substantially parallel to a crown facet to a direction at an angle of +2 degrees to the z axis. They are reflected by pavilion facets, reach pavilion facets on the other side, are reflected there, and are transmitted in an area from near the upper part of crown facets on the other side to the table facet to be emitted from the upper side of the diamond. Lights B have come in a range of directions at angles of +2 degrees to 90 degrees to the z axis. They reach pavilion facets on the other side, and are transmitted there to be emitted from the bottom side of the diamond.

Figure 10:
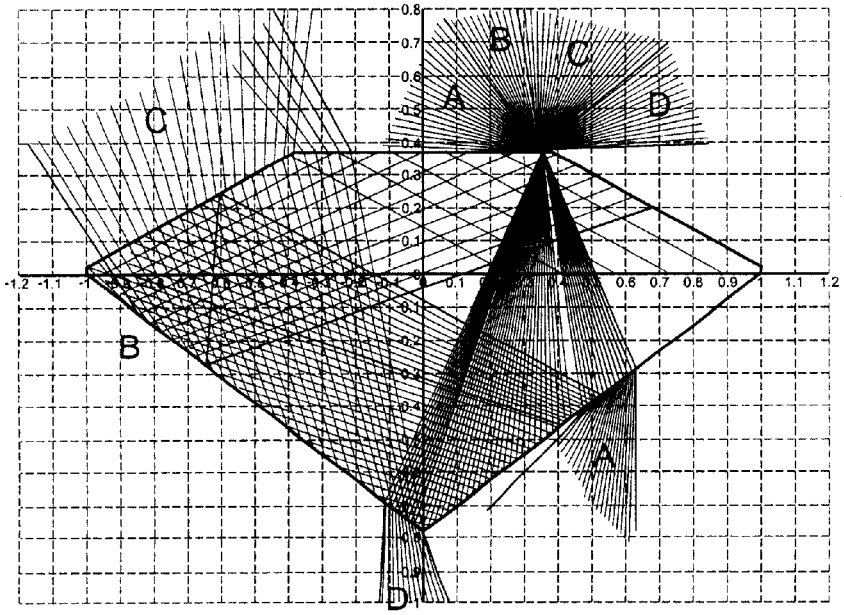
FIG. 10 is a diagram illustrating optical paths of lights coming in the table facet.

FIG. 10 shows the optical paths of lights coming in a position near the table facet, i.e. in a position of 0.35 in the ratio to the girdle radius, in the direction of the −z axis. Lights A have come in a range from a direction substantially parallel to the table facet to a direction at an angle of −35 degrees to the z axis. They reach pavilion facets, and are transmitted there to be emitted from the bottom side of the diamond. Lights B have come in a range of directions at angles of −35 degrees to −10 degrees to the z axis. They are reflected by pavilion facets, reach crown facets on the other side, are reflected there, reach pavilion facets on the other side, and are further reflected in the diamond a number of times. Lights C have come in a range of directions at angles of −10 degrees to +48 degrees to the z axis. They are reflected by pavilion facets, reach crown facets on the other side and the table, and are transmitted there to be emitted from the upper side of the diamond. Lights D have come in a range of directions at angles of +48 degrees to 90 degrees to the z axis. They are transmitted by pavilion facets on the other side to be emitted from the bottom side of the diamond.

Figure 11:
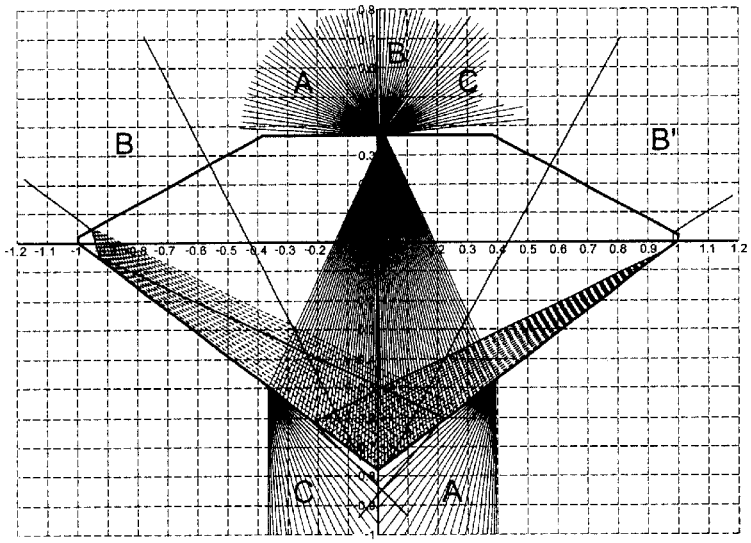
FIG. 11 is another diagram illustrating optical paths of lights coming in the table facet.

FIG. 11 shows the optical paths of lights coming in a position in the central part of the table facet, i.e. in a position of 0.02 in the ratio to the girdle radius, in the direction of the −z axis. Lights A have come in a range from a direction substantially parallel to the table facet to a direction at an angle of −35 degrees to the z axis. They reach pavilion facets, and are transmitted there to be emitted from the bottom side of the diamond. Lights B have come in a range of directions at angles of −3 degrees to +35 degrees to the z axis. Of these lights, lights in a range of −35 degrees to 0 degrees reach pavilion facets, are reflected there, reach the pavilion facets on the other side, are reflected there, and are transmitted by crown facets on the other side to be emitted from the upper side of the diamond. Lights in a range of 0 degrees to +35 degrees reach the pavilion facets on the other side, follow optical paths symmetric to those of the lights referred to in the above, and are transmitted by crown facets to be emitted from the upper side of the diamond. Lights C have come in a range of directions at angles of +35 degrees to 90 degrees to the z axis. They follow optical paths symmetric to those for lights A and are transmitted by pavilion facets on the other side to be emitted from the bottom side of the diamond.

It is evident from FIGS. 7 through 11 that most light coming in through the crown facets are finally emitted from the crown facets and some are emitted from the table facet, after being reflected in the diamond and changing the directions. Out of lights having come in the table facet, most of the lights returning from the diamond are emitted from crown facets. This presents a marked difference from what has been revealed by analysis of similar optical paths in conventional cut designs, i.e. most of the lights are emitted from the table facet.

Figure 12:
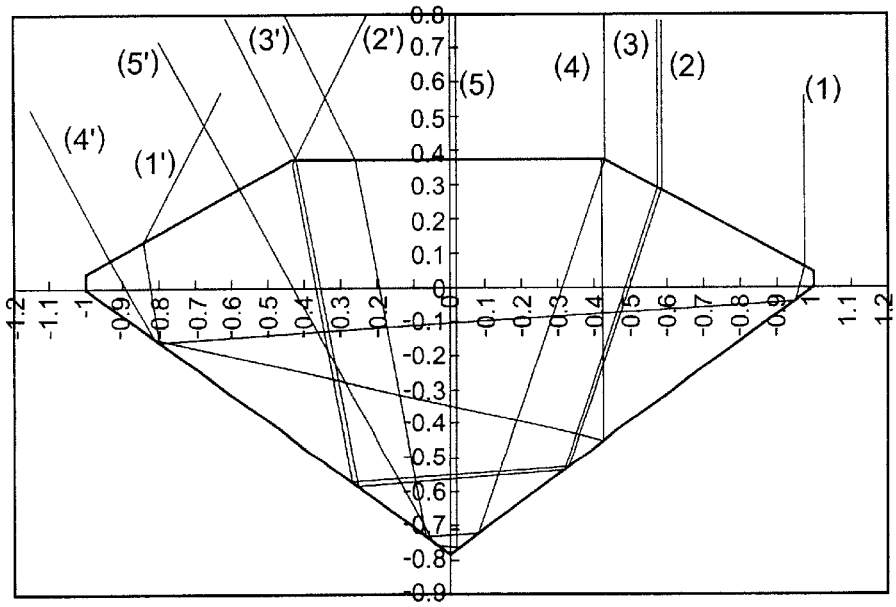
FIG. 12 is a diagram illustrating optical paths of lights coming in the −z axis direction out of the optical paths illustrated in FIGS. 7 through 11.

Out of the optical paths shown in FIGS. 7 through 11, paths of incident lights toward the −z axis direction are picked out and collectively shown in FIG. 12. In this diagram, the lights of (1) are, out of the lights shown in FIG. 7, what have come in crown facets near the girdle in the −z axis direction, and they are emitted from crown facets on the other side (denoted by (1')). The lights of (2) are what have come in crown facets in substantially the middle in the −z axis direction as shown in FIG. 8, and they are emitted from crown facets on the other side near the boundary with the table facet above (denoted by (2')). Or the lights may be emitted from the table facet near the boundary with crown facets on the other side. The lights of (3), having come near the boundary between crown facets and the table facet shown in FIG. 9, come in the −z axis direction, and are emitted from the table facet (denoted by (3')). The lights of (4), having come on the table facet near the boundary with crown facets as shown in FIG. 10, come in the −z axis direction, and are emitted from crown facets on the other side (denoted by (4')). The lights of (5), having come on substantially the middle of the table facet as shown in FIG. 11, come in the −z axis direction, and are emitted from crown facets on the other side (denoted by (5')).

Since optical paths are reversible, any optical path can be traced in the reverse direction. Therefore, the lights of (1') having come on a left side crown facet are emitted from right side crown facets as (1) in the +z axis direction. Similarly the lights of (2'), (3'), (4') and (5') are emitted as (2), (3), (4) and (5), respectively.

Lights having come on left side crown facets between (1') and (2') are emitted from right side crown facets between (1) and (2). Thus, they are lights that come on crown facets and are emitted from crown facets. Since lights having come on the table facet between (2') and (3') are emitted from right side crown facets between (2) and (3), they are lights that come on the table facet and are emitted from crown facets. Since lights having come incident on left side crown facets between (4') and (5') are emitted from the table facet between (4) and (5), they are lights that come on crown facets and are emitted from the table facet. It is thus seen that lights emitted in the +z direction are c-to-c lights, t-to-c lights and c-to-t lights.

Simultaneous Observation of c-to-c Lights, t-to-c Lights and c-to-t Lights

As there are three kinds of lights including c-to-c lights, t-to-c lights and c-to-t lights, the observer on the z-axis is keenly impressed with a perception of brilliancy and scintillation when these three kinds of lights, above mentioned, emerge into the +z axis direction simultaneously.

Since a diamond is usually exposed to the illumination from many light sources with various size, incident lights to the diamond come from many different directions. It has been made evident that, for an observer watching in the +z direction to be able to observe the three kinds of lights at the same time, the differences in the angle of incidence among these lights should be kept within ±7.4 degrees. For instance, if a diamond is illuminated from a position 3 meters apart and from 30 degrees inclined direction by a straight fluorescent lamp with length of 1 meter and 90% effective luminous range of the length in luminous energy, the irradiation angle of that light will be ±7.4 degrees.

As a result of calculation, it has been found that there exists a relationship between the pavilion angle p and the crown angle c of a diamond which makes the focal angles of c-to-c lights, t-to-c lights and c-to-t lights approximately equal to each other. The relations of the pavilion angles in degrees and the crown angles in degrees are listed in Table 1, with the focal angles above described and the differences of the focal angles, for the pavilion angle p of 37.6 degrees, 38.0 degrees, 38.4 degrees or 38.8 degrees. From TABLE 1, it can be concluded that,in order to keep the focal angle differences within ±7.4 degrees, the crown angle should be between or equal to 30.1 degrees and 32.0 degrees when the pavilion angle is 37.6 degrees, between or equal to 28.5 degrees and 30.6 degrees when the pavilion angle is 38.0 degrees, between or equal to 27.0 degrees and 29.2 degrees when the pavilion angle is 38.4 degrees, and between or equal to 25.5 degrees and 27.8 degrees when the pavilion angle is 38.8 degrees. This range is an area of the pavilion angle p and the crown angle c surrounded by two lines:

$$c=-3.8333\times p+174.232, \quad (1)$$

$$c=-3.5\times p+163.6. \quad (2)$$

Figure 15:
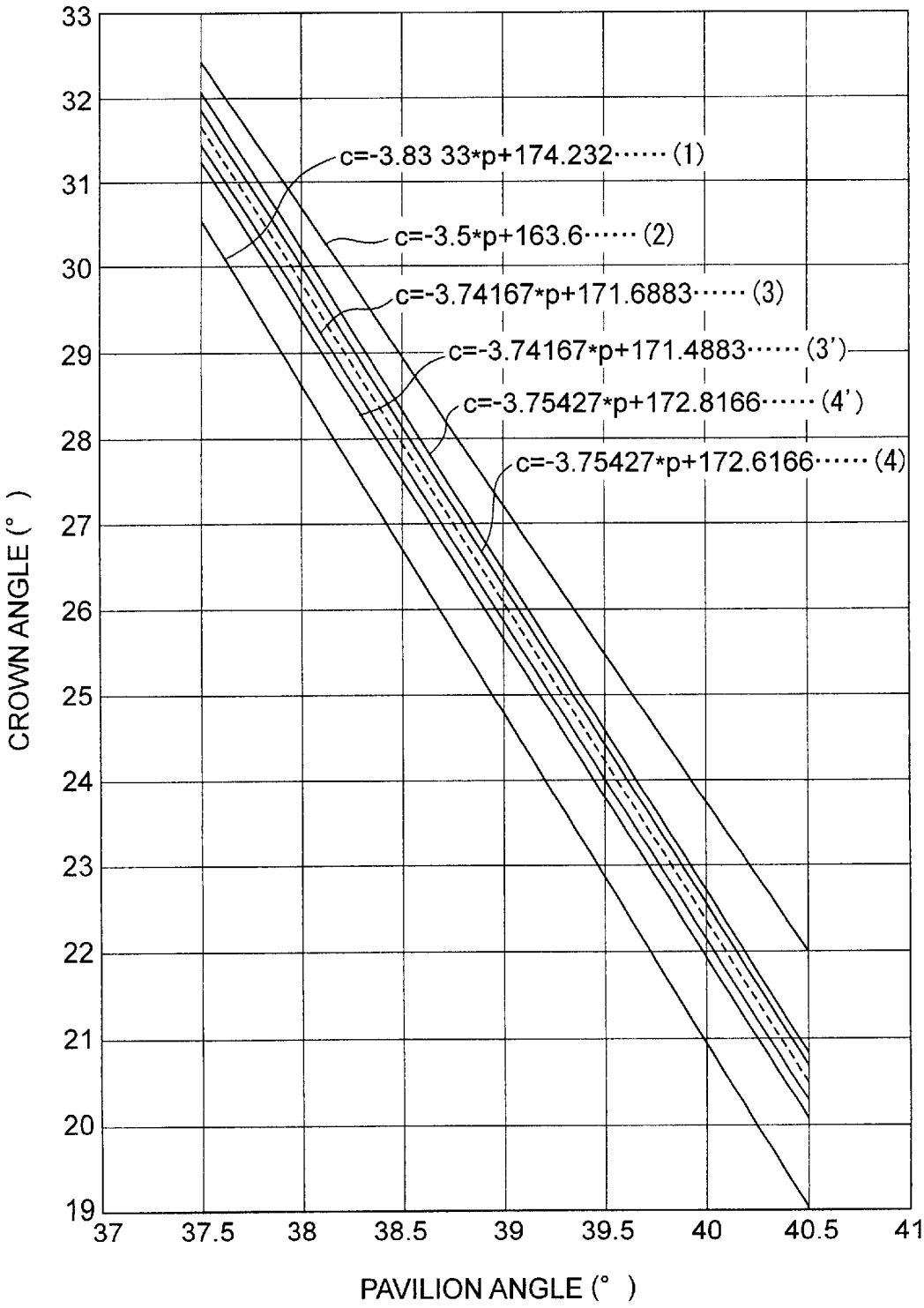
FIG. 15 is a graph showing the relationship between the crown angle and the pavilion angle for making three focal points coincide with each other.

This area is illustrated in the graph of FIG. 15.

TABLE 1

| Pavilion angle p | Crown angle c | Focal angle of c-to-c lights | Focal angle of t-to-c lights | Focal angle of c-to-t lights | Focal angle difference between c-to-c and t-to-c lights | Focal angle difference between c-to-c and c-to-t lights |
|---|---|---|---|---|---|---|
| 37.6 | 30.0695 | 20.7405 | −28.7883 | −28.93 | −8.0478 | −8.1895 |
| 37.6 | 30.2695 | 21.7458 | −28.4436 | −28.6445 | −6.6978 | −6.8987 |
| 37.6 | 31.2695 | 27.3202 | −26.7292 | −27.215 | 0.591 | 0.1052 |
| 37.6 | 31.8695 | 31.3016 | −25.707 | −26.3546 | 5.5946 | 4.947 |
| 37.6 | 32.0695 | 32.7912 | −25.3672 | −26.0671 | 7.424 | 6.7241 |

TABLE 1-continued

| Pavilion angle p | Crown angle c | Focal angle of c-to-c lights | Focal angle of t-to-c lights | Focal angle of c-to-t lights | Focal angle difference between c-to-c and t-to-c lights | Focal angle difference between c-to-c and c-to-t lights |
|---|---|---|---|---|---|---|
| 37.6 | 32.2695 | 34.3909 | −25.0279 | −25.7793 | 9.363 | 8.6116 |
| 38.0 | 28.3926 | 18.428 | −27.335 | −27.4398 | −8.907 | −9.0118 |
| 38.0 | 28.5926 | 19.3419 | −26.9971 | −27.1543 | −7.6552 | −7.8124 |
| 38.0 | 28.7926 | 20.2786 | −26.6597 | −26.8687 | −6.3811 | −6.5901 |
| 38.0 | 29.7926 | 25.3869 | −24.9805 | −25.4387 | 0.4064 | −0.0518 |
| 38.0 | 30.5926 | 30.2041 | −23.6452 | −24.2901 | 6.5589 | 5.914 |
| 38.0 | 30.7926 | 31.5605 | −23.3124 | −24.002 | 8.2481 | 7.5585 |
| 38.4 | 26.9157 | 17.242 | −25.5438 | −25.6641 | −8.3018 | −8.4221 |
| 38.4 | 27.1157 | 18.1047 | −25.2126 | −25.3786 | −7.1079 | −7.2739 |
| 38.4 | 28.3157 | 23.7337 | −23.2348 | −23.6623 | 0.4989 | 0.0714 |
| 38.4 | 29.1157 | 28.0891 | −21.924 | −22.5129 | 6.1651 | 5.5762 |
| 38.4 | 29.3157 | 29.287 | −21.5972 | −22.2246 | 7.6898 | 7.0624 |
| 38.4 | 29.5157 | 30.5405 | −21.2706 | −21.9359 | 9.2699 | 8.6046 |
| 38.8 | 25.4388 | 16.18 | −23.759 | −23.8884 | −7.579 | −7.7084 |
| 38.8 | 25.6388 | 17.0004 | −23.434 | −23.6028 | −6.4336 | −6.6024 |
| 38.8 | 26.6388 | 21.3614 | −21.8144 | −22.1725 | −0.453 | −0.8111 |
| 38.8 | 26.8388 | 22.2954 | −21.4916 | −21.8858 | 0.8038 | 0.4096 |
| 38.8 | 27.6388 | 26.304 | −20.2031 | −20.7355 | 6.1009 | 5.5685 |
| 38.8 | 27.8388 | 27.3888 | −19.8817 | −20.447 | 7.5071 | 6.9418 |
| 38.8 | 28.0388 | 28.5142 | −19.5605 | −20.158 | 8.9537 | 8.3562 |

Coincidence of Focal Angles Among c-to-c Lights, t-to-c Lights and c-to-t Lights When the angles between the incident and emitted rays of c-to-c lights, t-to-c lights and c-to-t lights are made equal, i.e. in the trifocal state, the diamond increases its brilliancy and scintillation. Thus, in the trifocal state, the incident lights from the same light sources on the diamond are simultaneously emitted toward the observer, and the brilliancy and scintillation perceived by the observer are enhanced consequently.

These focal angles vary with the crown angle and the pavilion angle. The relationship between the focal angle in degrees and the crown angle in degrees is graphed in FIG. 13 with the pavilion angle p in degrees as the parameter, while that between the focal angle and the pavilion angle is graphed in FIG. 14 with the crown angle c as the parameter. (These graphs use violet light of 396.8 nm in wavelength (spectral H line).) As is evident from these graphs, the focal angles of t-to-c lights and c-to-t lights decrease with increases in the crown angle and the pavilion angle, and these curves are approximately in the same inclination. However, the focal angle of c-to-c lights significantly increases with increases in the crown angle and the pavilion angle. When the crown angle and the pavilion angle are cut so as to make these focal angles identical, brilliancy and scintillation are enhanced. For instance, when the crown angle is 29.5 degrees and the pavilion angle is 38 degrees, the trifocal angles become identical to enhance the brilliancy and scintillation. In addition to this combination of the pavilion angle and the crown angle, when the crown angle is 28.5 degrees and the pavilion angle is 38.25 degrees, the focal angles also become identical and trifocal.

Between a crown angle c in degrees and a pavilion angle p in degrees that make the focal angles identical, as shown in FIG. 15, there was found to be an approximate relationship of:

$$c=-3.74167\times p+171.6883 \quad (3)$$

where violet light of 396.8 nm in wavelength (spectral H line) was used.

A diamond is usually observed under white light. As white light is a mixture of lights of all different wavelengths from dark red light (759.4 nm) to violet light (396.8 nm), if a crown angle-pavilion angle combination is so cut as to establish the trifocal state at some wavelength, the angles will exert a combined enhancing effect on brilliancy and scintillation. In order for dark red light of 759.4 nm in wavelength to have identical trifocal angles, the relationship between the crown angle c and the pavilion angle p should be approximately:

$$c=-3.75427\times p+172.6166 \quad (4)$$

and this line is also shown in FIG. 15.

A diamond having crown angles c and pavilion angles p in the area between line (3) and line (4) in FIG. 15 has identical focal angles with respect to some component or other of white light.

In a diamond of a cut design according to the present invention, incident light separates into its spectral components as will be described afterwards. Therefore, if the diamond has crown angles c and pavilion angles p in an area close to line (4), incident white light would separate into its spectral components, which, from red to violet, would emerge on the observed facets (the table facet and the crown facets) of the diamond.

Range of Pavilion Angle p and Crown Angle c

Whereas the crown angle c and the pavilion angle p which would make focal angles identical according to the present invention lie in the area between line (3) and line (4) in FIG. 15, it is more preferable for the pavilion angle p to be between or equal to 45 degrees and 37.5 degrees.

Where the pavilion angle p is 45 degrees, the incident light and the reflected light are almost parallel, and all the focal angles are identical at 0 degrees. Thus, the incident light enters the diamond from the direction in which the observer is and is emitted toward the observer.

In order for the incident light travelling from a light source behind the observer toward the diamond to enter into the diamond, to be reflected by the diamond and to cause the reflected light to travel toward the observer on the z-axis and 250 mm to 300 mm apart from the diamond, there has to be an angle of about 18 degrees between the incident light and the reflected light. In order for the angle formed by the incident light and the reflected light to be 18 degrees or more, the pavilion angle should be no more than 40 degrees. Therefore, it is preferable to keep the pavilion angle at or less than 40 degrees.

If the pavilion angle is less than 37.5 degrees, lights coming on the upper part of the main crown facets, i.e. the area close to their edges with the table, leak behind the diamond through the part near the culet of the pavilion facets. Viewed the other way around, there will be no light coming out of the upper part of the main crown facets visible to the observer in the +z axis direction of the diamond, and the observer will find that part dark. Thus, it is necessary for the pavilion angle to be no less than 37.5 degrees.

Tolerance

Whereas there is the above-stated relationship between crown angles and pavilion angles enabling focal angles to be identical, errors within about ±0.2 degrees are permissible for crown angles, and within about ±0.05 degrees for pavilion angles.

Figure 13:
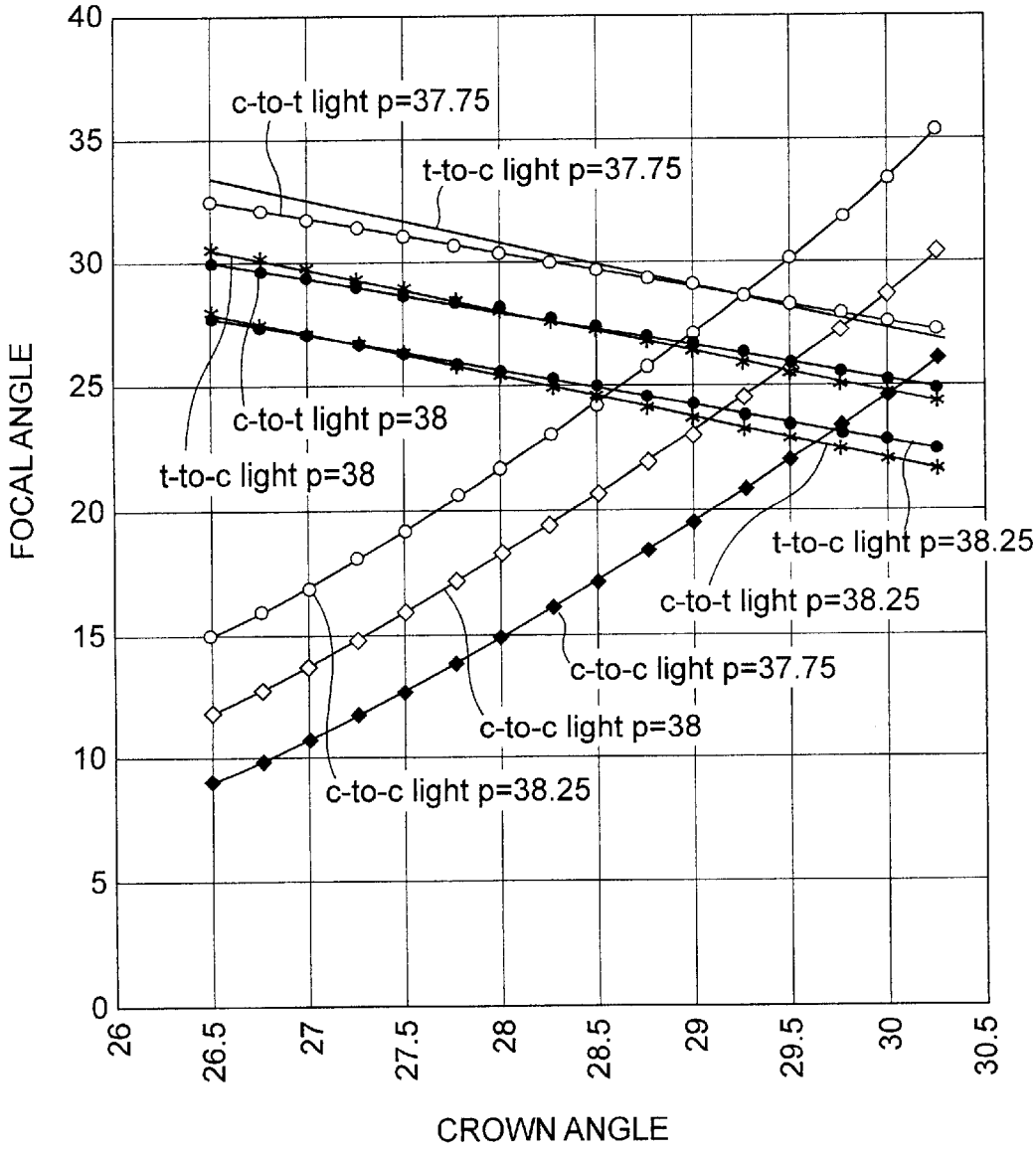
FIG. 13 is a graph showing the relationship between the focal angle and the crown angle with the pavilion angle as the parameter.

Since a difference of 1 degree or so in the angle at which light enters the observer's eyes can be assumed to mean no difference in light source, it is desirable to prescribe crown angles and pavilion angles so as to keep focal angle differences within 1 degree. The contribution of the crown angle on the focal angle, as is seen from FIG. 13, is 5.29 degrees per degree of the crown angle for c-to-c lights and −1.74 degrees per degree of the crown angle for t-to-c lights and c-to-t lights. To keep the range of focal angle fluctuations of c-to-c lights, which are more heavily affected, within ±1 degree, it is preferable to keep that of the crown angle within ±0.2 degrees.

Figure 14:
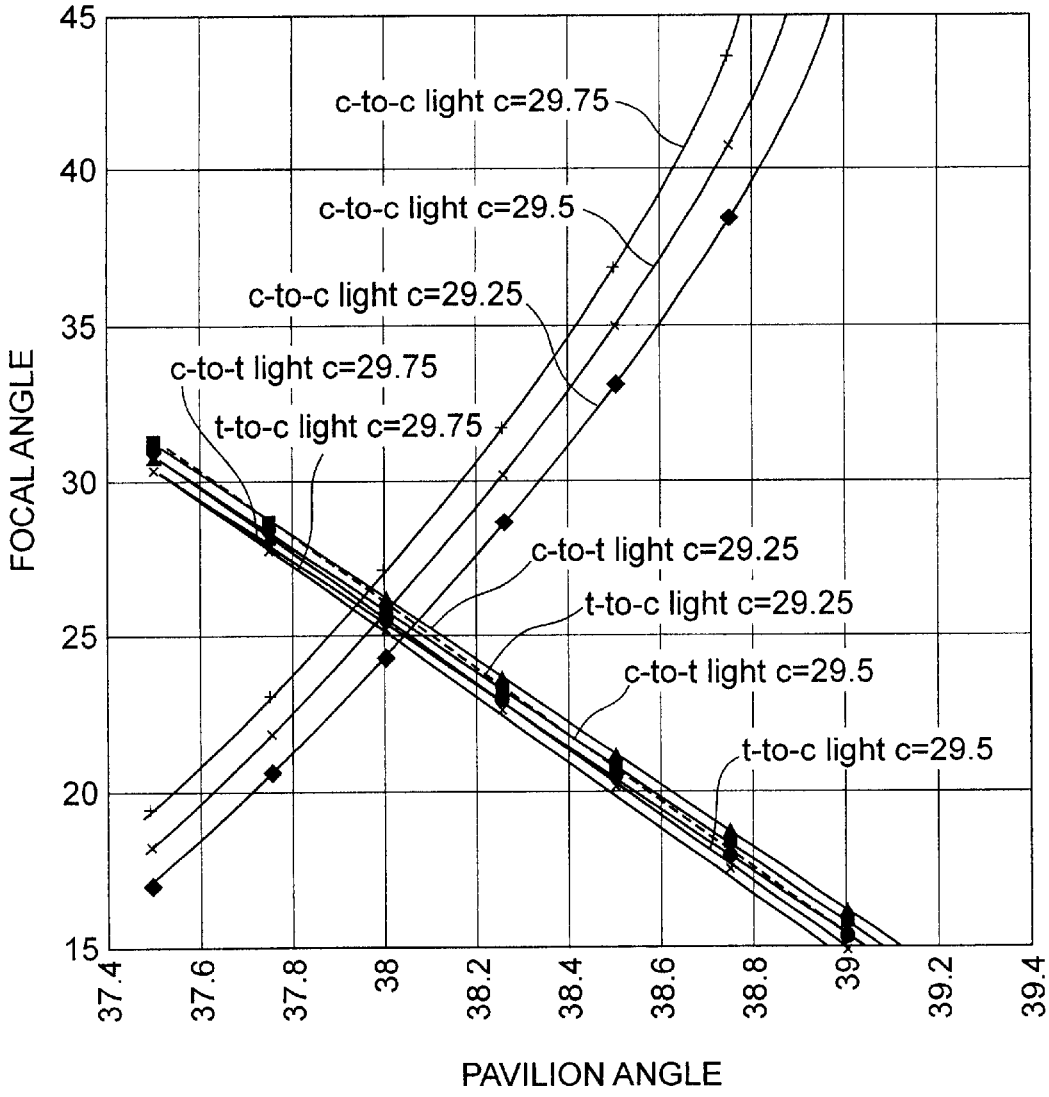
FIG. 14 is another graph showing the relationship between the focal angle and the pavilion angle with the crown angle as the parameter.

The contribution of the pavilion angle on the focal angle, as is seen from FIG. 14, is 19.08 degrees per degree of the pavilion angle for c-to-c lights and −9.92 degrees per degree of the pavilion angle for t-to-c lights and c-to-t lights. To keep the range of focal angle fluctuations of c-to-c lights, which are more heavily affected, within ±1 degree, it is preferable to keep that of the pavilion angle within ±0.05 degrees.

Then, to tolerate focal angle deviation within ±1 degree, crown angles are allowed to fluctuate within ±0.2 degrees. Therefore, the crown angles and the pavilion angles should be kept within the area between a line shifted by −0.2 degrees in crown angle in parallel to line (3) in FIG. 15 and a line shifted by +0.2 degrees in crown angle in parallel to line (4) in FIG. 15. Thus, if focal angles are made equal and trifocal,the crown angle c and the pavilion angle p are in a range surrounded by values represented by the following two equations:

$$c=-3.74167\times p+171.4883, \quad (3')$$

and $$c=-3.75427\times p+172.8166. \quad (4')$$

Whereas the relationship between the crown angle c and the pavilion angle p to make focal angles of the white light identical was stated above, in order to obtain reflected lights powerful in blue brilliancy and scintillation, focal angles should be identical in the range of violet light (396.8 nm) to dark blue light (486.1 nm). The area where focal angles of dark blue light (486.1 nm) can be identical is marked with a bold broken line in FIG. 15. The relation can be approximately expressed as:

$$c=-3.7239\times p+171.2315, \quad (5)$$

with errors due to fluctuations of focal angles considered.

Then, the crown angle c and the pavilion angle p should be kept in the area between the following two equations, equation (3') shifted by −0.2 degrees in crown angle in parallel to equation (3) and equation (5') shifted by +0.2 degrees in crown angle in parallel to equation (5). Incidentally, line (5') is not shown in FIG. 15 to avoid unnecessary complication of the graph.

$$c=-3.74167\times p+171.4883 \quad (3')$$

$$c=-3.7239\times p+171.4315 \quad (5')$$

Size of Table Facet

According to the present invention, it is preferable to keep the table facet small and to have large crown facets. While the diameter of the table facet can be kept between or equal to 0.60 and 0.33 in its ratio to the girdle diameter, in order to increase the crown facet size, it is preferable to keep the table facet diameter-girdle diameter ratio between or equal to 0.55 and 0.38. As illustrated in FIGS. 7 through 12 and described above, the cut design according to the invention has a greater proportion of c-to-c lights, the diameter of the table facet is rather made small, compared to a conventional cut design, from the view point of increasing the crown facet size.

Figure 16:
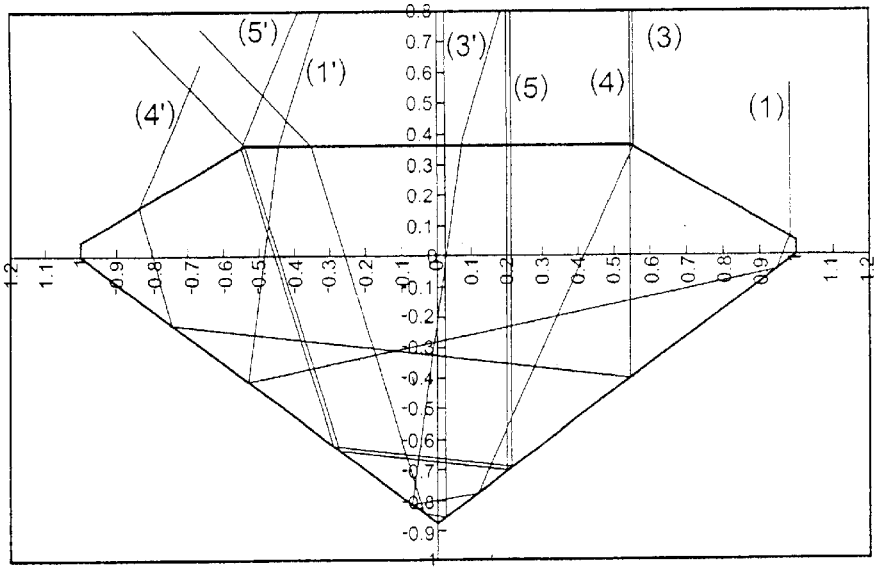
FIG. 16 PRIOR ART
FIG. 16 is a diagram illustrating paths of lights coming in the −z axis direction in a conventional cut.

Results of study on optical paths in a conventional cut having a crown angle c of 34.5 degrees, a pavilion angle p of 40.75 degrees and a table diameter ratio t of 0.53 are shown in FIG. 16. As in FIG. 12, the relationship of lights emitted in the z axis direction with incident lights is illustrated here. The lights emitted from crown facets are those having come in the table facet, and the lights emitted from the table facet are those having come in crown facets and the table facet. Expressed in the signs used in the foregoing description, there are t-to-c lights and c-to-t lights, but no c-to-c lights. In such a cut design according to the prior art, the table facet showed significant brilliancy and scintillation. In this case, the diameter of the table facet, 0.53, was reasonable for the brilliancy and scintillation of the table.

The present invention, by contrast, can expand the area of the crown facets by minimizing the diameter of the table facet in its ratio to the girdle diameter and enhance the brilliancy and scintillation of the crown facets. However, if the table diameter ratio surpasses 0.55, out of the lights coming in the −z axis direction those coming in around the table leak downward around the pavilion facets. In other words, out of the lights coming on the table and the crown facets, no lights will be emitted from the outer region of the table facet, and therefore the area turns dark. The dark part would expand with an increase in the table diameter ratio. If the table diameter ratio is reduced from 0.55 to 0.38, there will no longer be a dark part on the table facet and the crown facets, and these parts will become bright instead. However, if the diameter of the table facet is reduced to less than 0.38, among the incident lights in the −z axis direction, those coming into upper crown facets (those near the table) will leak from the apex of pavilions. Therefore, the area turns dark. The crown facets, and accordingly the dark part, would expand with a decrease in the table facet size. If the table diameter ratio is reduced to less than 0.33, this dark part will become significantly large.

For the reasons stated above, the table diameter in its ratio to the girdle diameter can be selected between or equal to 0.60 around 0.33, preferably between or equal to 0.55 and 0.38.

Scintillation

Light reflection of a diamond is often evaluated by the degrees of brilliancy (quantity of reflection), scintillation and fire or dispersion (separation into spectral components). Of these criteria, brilliancy represents the intensity of reflected lights or the quantity of reflection. Therefore, a diamond in a cut design according to the invention with trifocal angles excels in brilliancy, as described above in detail, since it emits lights from crown facets and the table facet simultaneously towards the z-axis direction.

A diamond according to the invention excels over a diamond of a conventional design in scintillation and dispersion as well. Whereas incident lights from many different directions on the table facet and crown facets of a diamond, which are its usually observed facets, are reflected within the diamond and emitted from the table facet and crown facets, a diamond according to the invention has the finer patterns of reflection on the crown facets to result in enhanced scintillation.

Furthermore, when lights come from many different directions on the table facet and crown facets of a diamond according to the invention, the spectral angles of lights emitted from the crown facets, especially the main facets (among the crown facets) and upper girdle facets, become greater to manifest colors, resulting in excellent dispersion.

Particularly upper girdle facets of the crown and lower girdle facets of the pavilion contribute to these two items, scintillation and dispersion. In a diamond according to the invention, in which the pavilion angle and the crown angle are small, as the angles between lower girdle facets and upper girdle facets are narrowed and accordingly some rays of incident light into the diamond are reflected as many as eight times or so inside the diamond in contrast to three or four times in a conventional cut design, both scintillation and dispersion are increased.

Now with reference to FIG. 1, the projection of the distance (radius) from the central axis (z axis) of the diamond to the culet side apex 181 of lower girdle facets 18 in the pavilion portion toward a plane (zx plane) passing the girdle side apex 171 of main facets 17 in the pavilion portion and the central axis (z axis) of the diamond is represented by Gd. Gd is the distance from the z axis on the zx plane to the culet side apex 181 of pavilion lower girdle facets, and substantially the product of the direct distance from the central axis (z axis) by cos 22.5 degrees. The length of Gd affects scintillation and dispersion. The smaller the length of Gd, the greater the area of lower girdle facets and the narrower the angles between the lower girdle facets and the upper girdle facets, resulting in a finer pattern of reflected lights and the concentration of the finer pattern around the periphery of crown facets. This makes the pattern even finer. The length of Gd should be no more than 3/10 of the radius of the girdle. More preferably it should be 0.25 or less, and around 0.2 is especially preferable.

If the table facet diameter is reduced in its ratio to the girdle diameter, crown facets will become greater and, along with that, the star facets, main facets and upper girdle facets in the crown part will also expand. As a result, the area of parts excelling in scintillation and dispersion will become larger.

As upper girdle facets 16 are made more upright relative to the central axis of the diamond by varying the square measure ratio between star facets 15 and upper girdle facets 16, reflected lights from the upper girdle facets become brighter, and so does the periphery of the diamond.

While observation reveals the foregoing, tracing optical paths by calculation has resulted in confirmation of the following.

In order to confirm scintillation of reflected lights, optical paths of lights having come in the table facet and crown facets and reflected within the diamond were calculated, and the intensity pattern of lights reflected from the table facet and crown facets in the z axis direction was figured out. Using a light of 550 nm in wavelength (2.423 in refractive index), the intensity of light emerging in the z axis direction out of each mesh of a grid of 0.01×0.01 (in the ratio to the girdle radius being represented by 1) marked over the table facet and crown facets of the diamond was calculated in terms of the ratio to the incident light to the diamond. Intensities were graphed for a 1/16 segment (equivalent to 22.5 degrees) of the circumference of the top surface of the diamond. As every 1/8 of the circumference of a diamond is rotationally symmetric with respect to the z axis and each 1/8 is symmetric with respect to the central plane involving its z axis, any 1/16 of the circumference can represent the whole.

Figure 18:
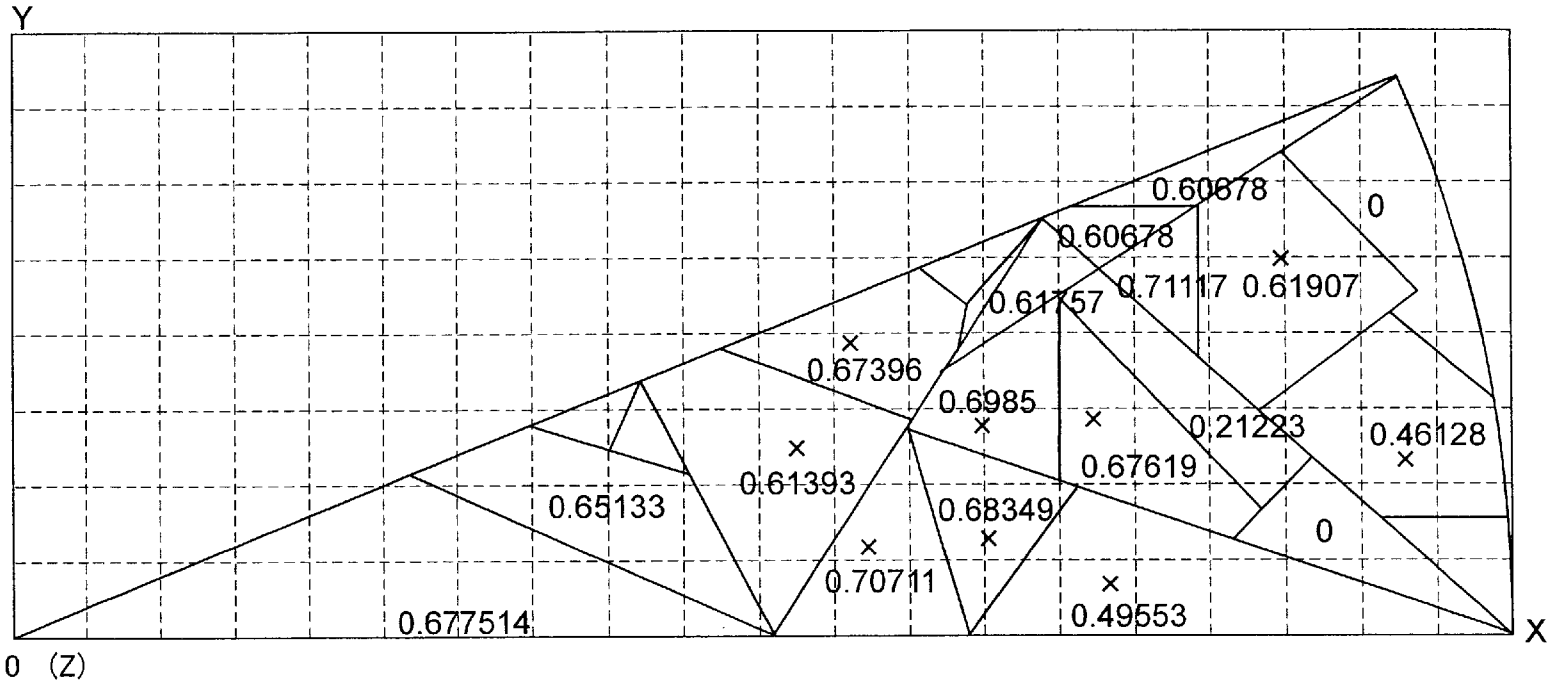
FIG. 18 is a diagram illustrating the intensity ratio pattern of reflected light to incident light with a diamond according to the invention.
Figure 19:
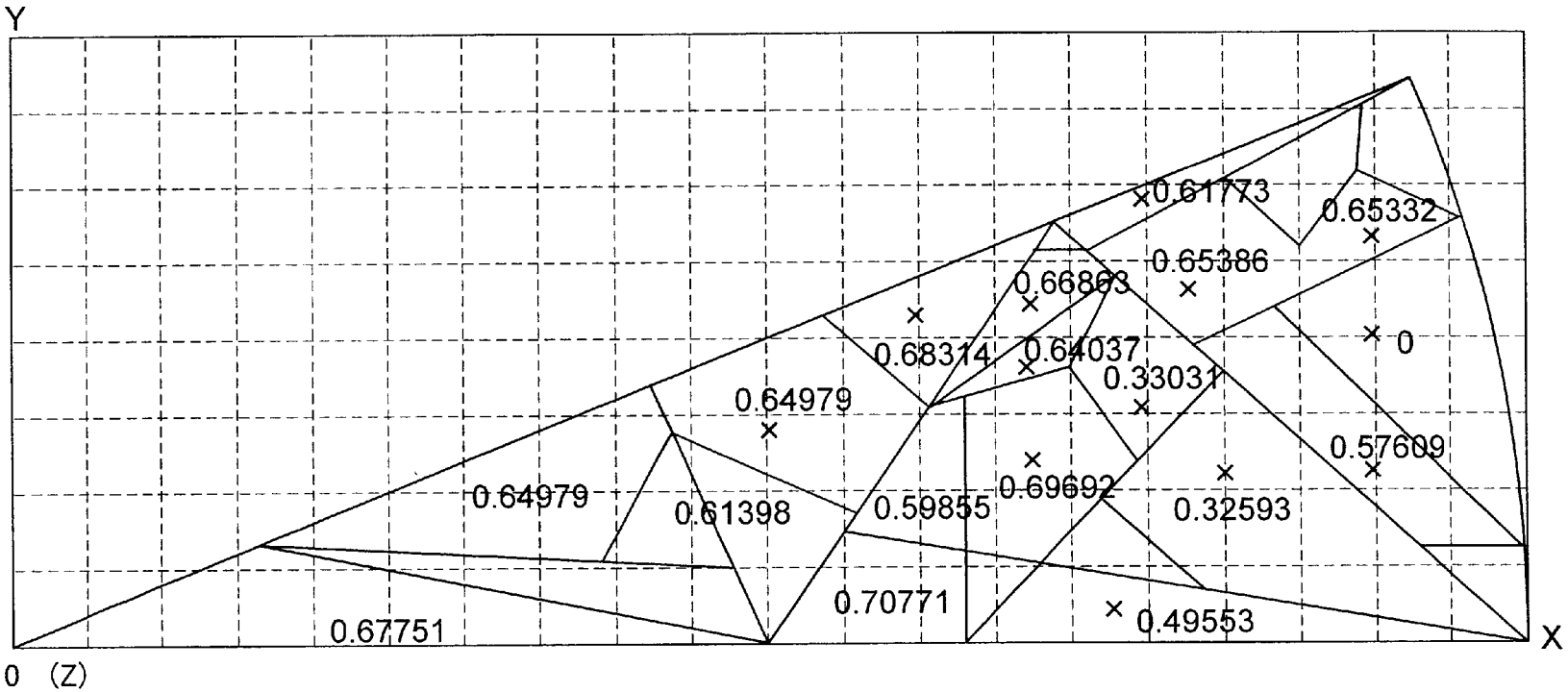
FIG. 19 is another diagram illustrating the intensity ratio pattern with a diamond according to the invention.
Figure 20:
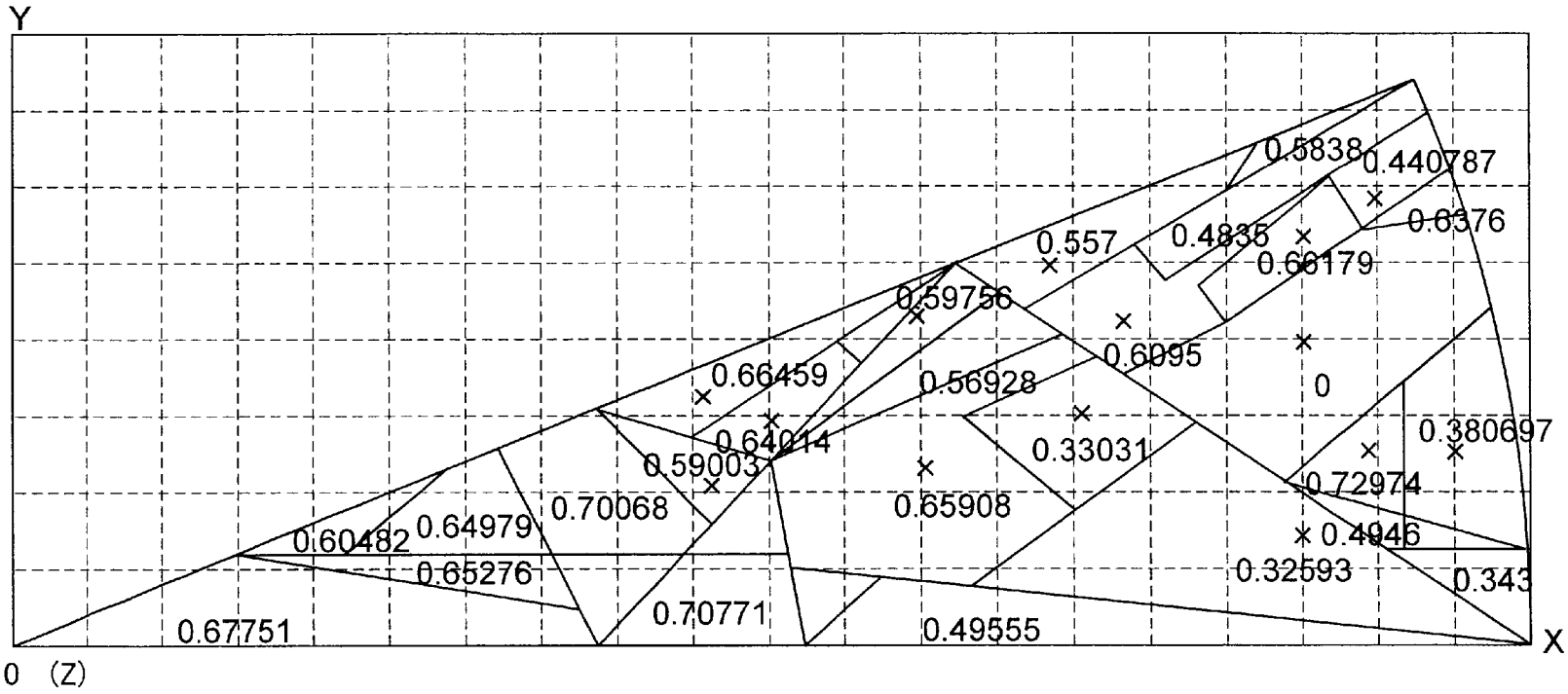
FIG. 20 is still another diagram illustrating the intensity ratio pattern with a diamond according to the invention.
Figure 21:
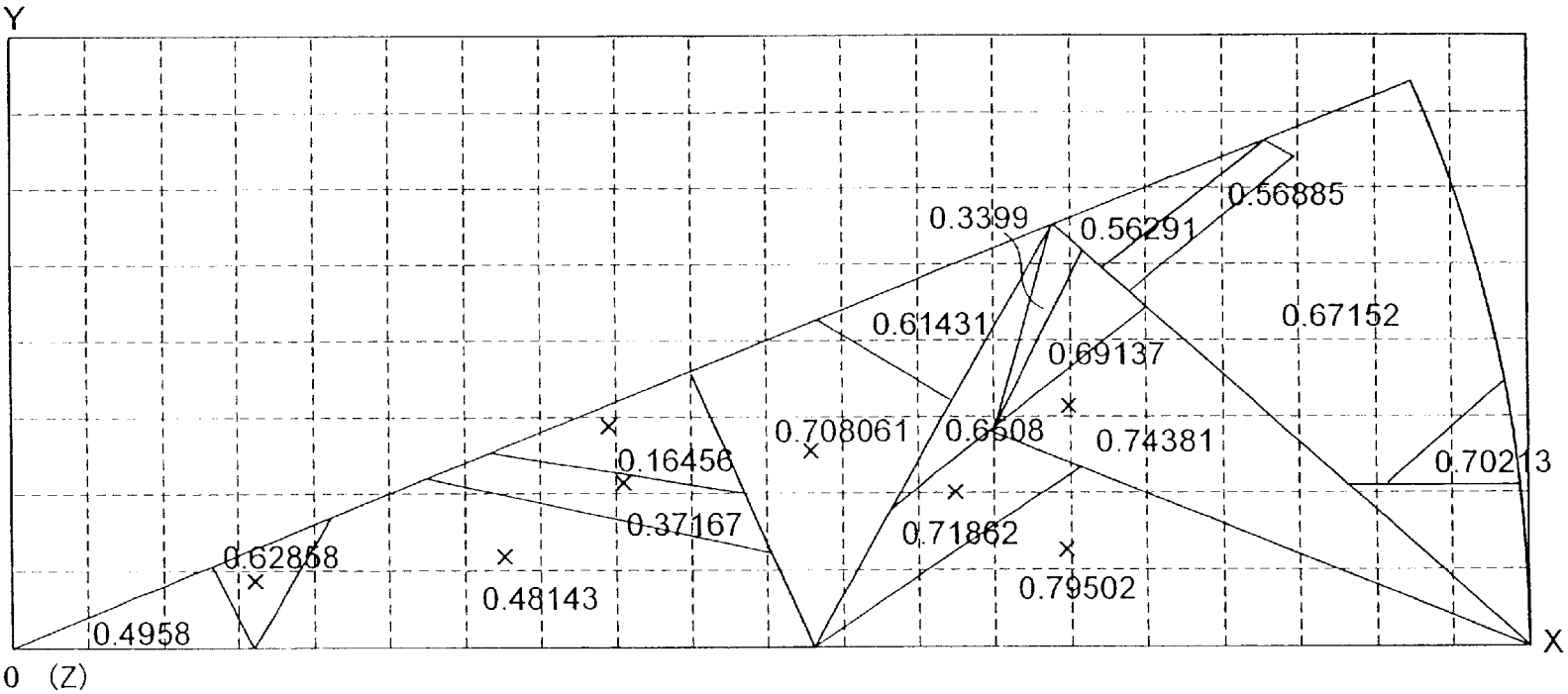
FIG. 21 PRIOR ART
FIG. 21 is a diagram illustrating the intensity ratio pattern with a diamond according to the prior art.

Taking diamonds according to the present invention with a pavilion angle of 38.5 degrees, a crown angle of 27.9 degrees, a table facet diameter ratio to the girdle diameter of 0.5 and a Gd value of either 0.33 and 0.16, intensity patterns of reflection were calculated, which are shown in FIGS. 18 and 19, respectively. Another diamond according to the invention with the same pavilion angle of 38.5 degrees and crown angle of 27.9 degrees and with reduced table diameter ratio to 0.38 and in Gd to 0.16 is shown in FIG. 20. Furthermore, intensity patterns of reflection were also calculated for a conventional cut-designed diamond with a pavilion angle of 40.75 degrees, a crown angle of 34.5 degrees, a table facet diameter ratio of 0.53 and a Gd value of 0.314 is shown in FIG. 21, for comparison. Numerals marked in FIGS. 18 through 21 are typical reflected light intensities of the respective patterns, and the diagrams also show cut lines emerging on the top surface of the diamond as viewed in the z-axis direction. In the figures, numeral zero means no reflected light on the region.

Compared to the luminous intensity pattern of the diamond of the conventional cut design, those of the diamonds according to the invention shown in FIGS. 18 through 20 are finer. To compare the diamonds according to the invention shown in FIGS. 18 through 20 with one another, the pattern of FIG. 20 whose table facet diameter ratio is reduced is finer than those of FIGS. 18 and 19, and to compare the patterns of FIGS. 18 and 19, the latter whose Gd is 0.16 is finer than that of FIG. 19 having a Gd value of 0.33.

These figures reveal not only that the reflected light intensity pattern of a diamond according to the invention is finer than that of a diamond of a conventional cut design but also that the luminous intensity pattern of a diamond according to the invention becomes finer as its table facet diameter ratio is reduced and as its Gd value is reduced.

Separation Into Spectral Components

It was checked how lights coming in crown facets separate within a diamond into their spectral components. A diamond of a cut design according to the invention having a crown angle c of 26.7 degrees, a pavilion angle p of 38.75 degrees, a table diameter ratio of 0.38 and a girdle height of 0.026 and another of a conventional cut design having a crown angle c of 34.5 degrees, a pavilion angle p of 40.75 degrees, a table diameter ratio of 0.53 and a girdle height of 0.026 were used to check lights coming on main facets and upper girdle facets out of the crown facets.

White light rays in which wavelengths of 760 nm to 400 nm were mixed were used, and an incident ray was made and passes through at each meshed position of 0.0125×0.025 intervals (in ratios to the girdle). The incident light rays with various inclination to the z-axis and directional angle to xy-plane spread and get colored on their paths after some reflections on the condition that the incident angle of the red component to a facet is not greater than the critical angle for red and at the same time the incident angle of the blue component is greater than the critical angle for blue. In the case that the rays have the inclinations to the z-axis changing by 2 degrees up to 90 degrees and the directional angles to xy-plane changing by 45 degrees up to the whole circumference. The number of rays were counted which satisfy the above mentioned condition.

When the angle of the dispersed rays into color component is not greater than the critical angle for red, 24.51 degrees as example, the red component of the rays is refracted and emitted outside. When the angle of the same rays is greater than the critical angle for blue, 23.936 degrees as example, at the same time, the blue component of the rays is reflected and remains inside of the diamond and finally makes a colored pattern. The number of such separated and emitted light rays is listed in Table 2.

TABLE 2

| | | The invention | Conventional cut |
|---|---|---|---|
| Lights incident on crown main facets | Total number of incident light rays | 20,097 | 15,964 |
| | Number of separated and emitted rays | 153 | 101 |
| | Proportion of separated and emitted rays | 0.76% | 0.63% |
| Lights incident on upper girdle facets | Total number of incident light rays | 13,287 | 7,488 |
| | Number of separated and emitted rays | 682 | 210 |
| | Proportion of separated and emitted rays | 5.13% | 2.8% |

As is seen from this table, the proportion of 650 nm and above components separated and emitted outside of light rays coming incident on upper girdle facets is 5%, and this proportion, as well as the total numbers of such rays, is double that in any conventional cut.

Figure 17:
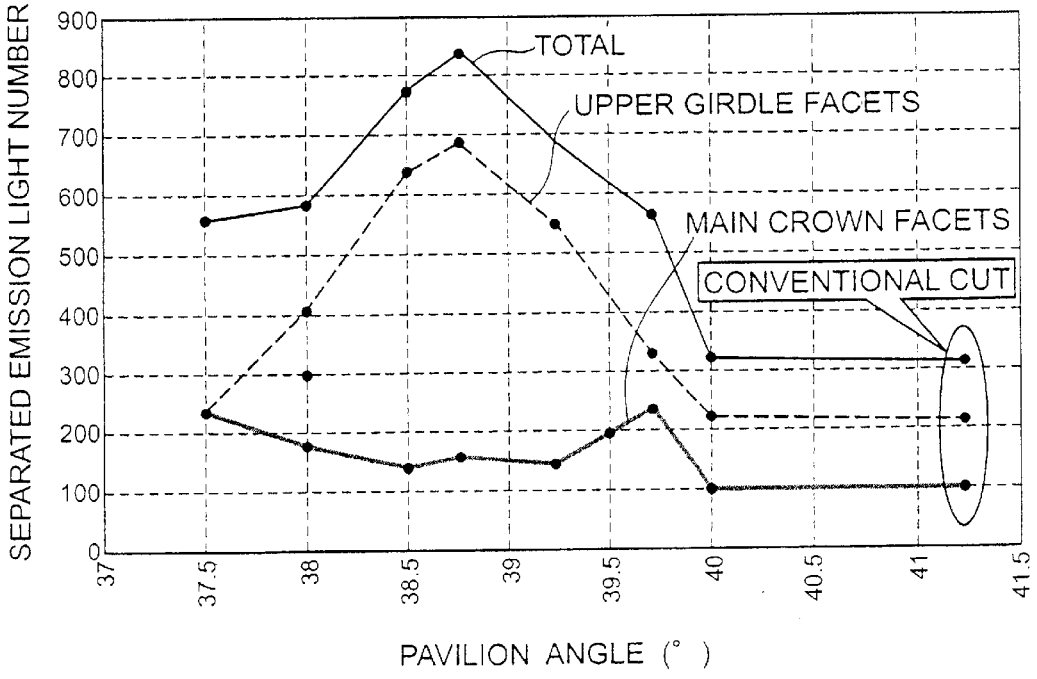
FIG. 17 is a graph showing the relationship between the number of separated emission lights and the pavilion angle.

Whereas the number of separated emission light rays is counted here of a case in which the pavilion angle is 38.75 degrees, widening the pavilion angle p beyond 38 degrees in a cut design according to the invention would result in an increase in the number of separated emission light rays, which reaches its maximum at a pavilion angle p of 38.75 degrees. At any wider pavilion angle, the number of separated emission light rays will gradually decrease, and at a pavilion angle p of 40 degrees it is very small, comparable to that of any conventional cut. This trend is illustrated in the graph of FIG. 17. In FIG. 17, the horizontal axis represents the pavilion angle p; the dotted line shows the number of light rays separated and emitted out of the lights having come incident on upper girdle facets; and the gray line shows the number of light rays separated and emitted out of the lights having come in upper main crown facets. Where the pavilion angle p is 40 degrees (crown angle c: 21.75 degrees), the number of separated emission light rays was comparable to that of any conventional cut. This means the necessity of keeping the pavilion angle less than 40 degrees for colored patterns.

Using white light rays in which wavelengths of 760 nm to 400 nm were mixed as incident lights, color patterns provided by spectral components to crown facets and the table facet were checked. The difference between emission angle for red component with wavelength of 686.4 nm (2.4073 in refractive index) and emission angle for blue component with wavelength of 430.8 nm (2.4514 in refractive index) out of the reflected lights was figured out, and regarded as the magnitude of separation (dispersion). The positions and angles of incidence were the same as those in determining the distribution of scintillation, and separation was calculated for a segment of the top face of the diamond corresponding to 1/16 (22.5 degrees) of the circumference, and angle difference patterns were graphed. These angle difference patterns represent what is visible as a color pattern when the diamond is observed from the upper position.

Figure 22:
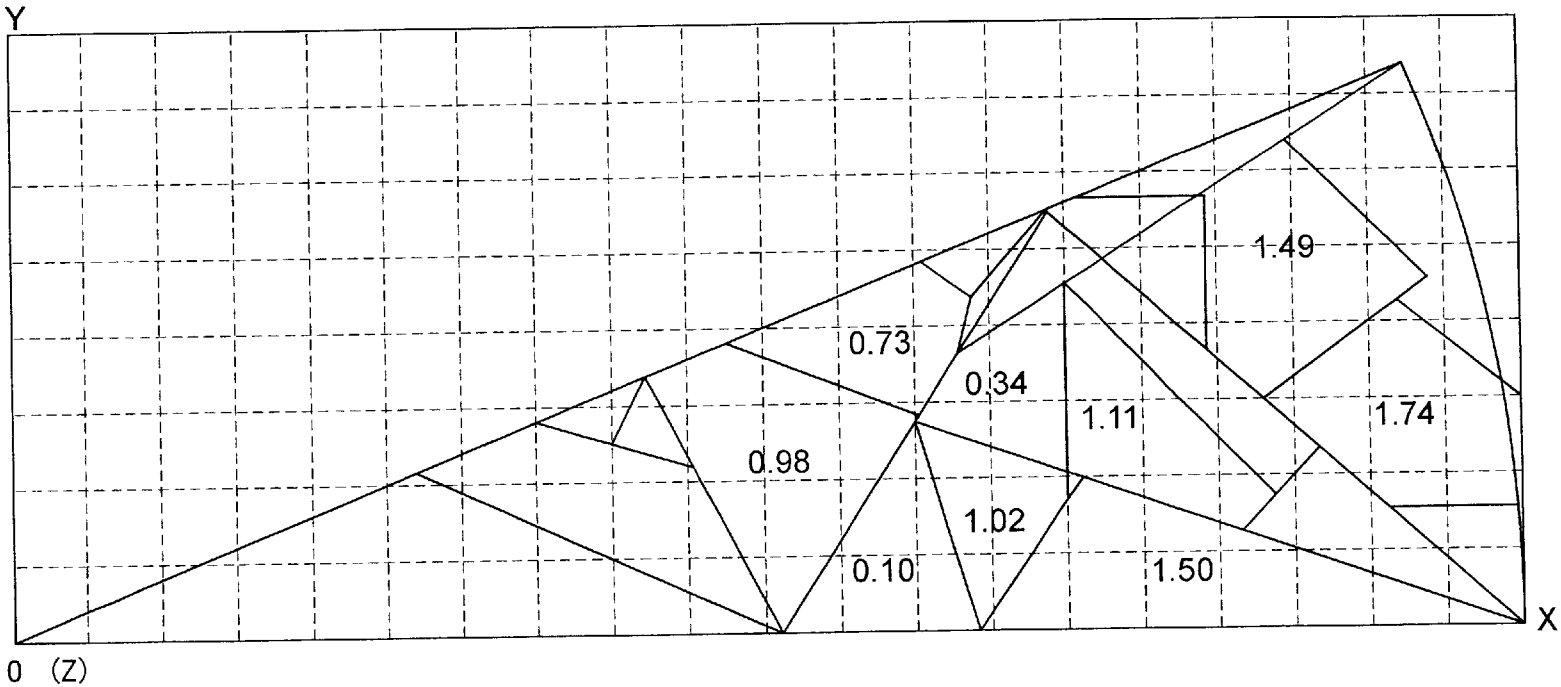
FIG. 22 is a diagram illustrating the pattern of reflected light angle differences of a diamond according to the invention.
Figure 23:
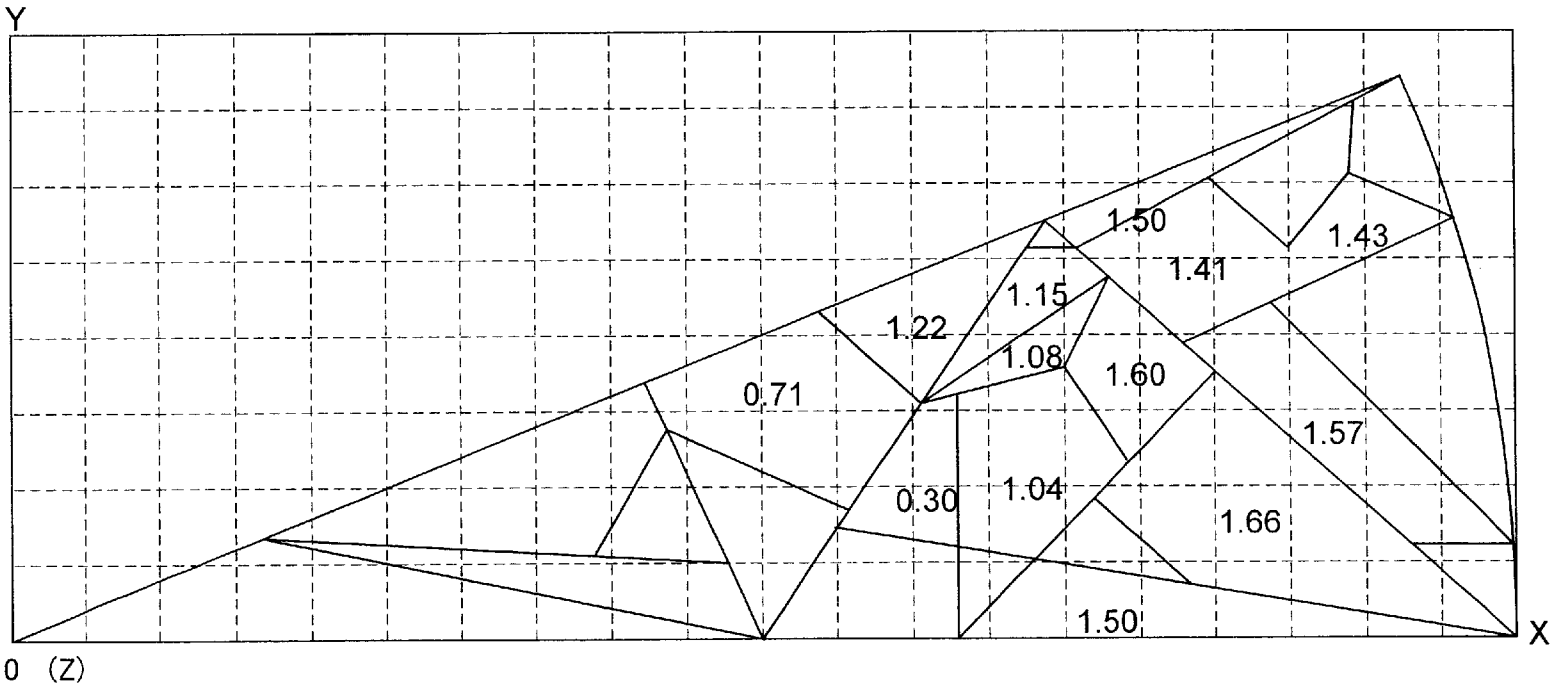
FIG. 23 is another diagram illustrating the pattern of reflected light angle differences of a diamond according to the invention.
Figure 24:
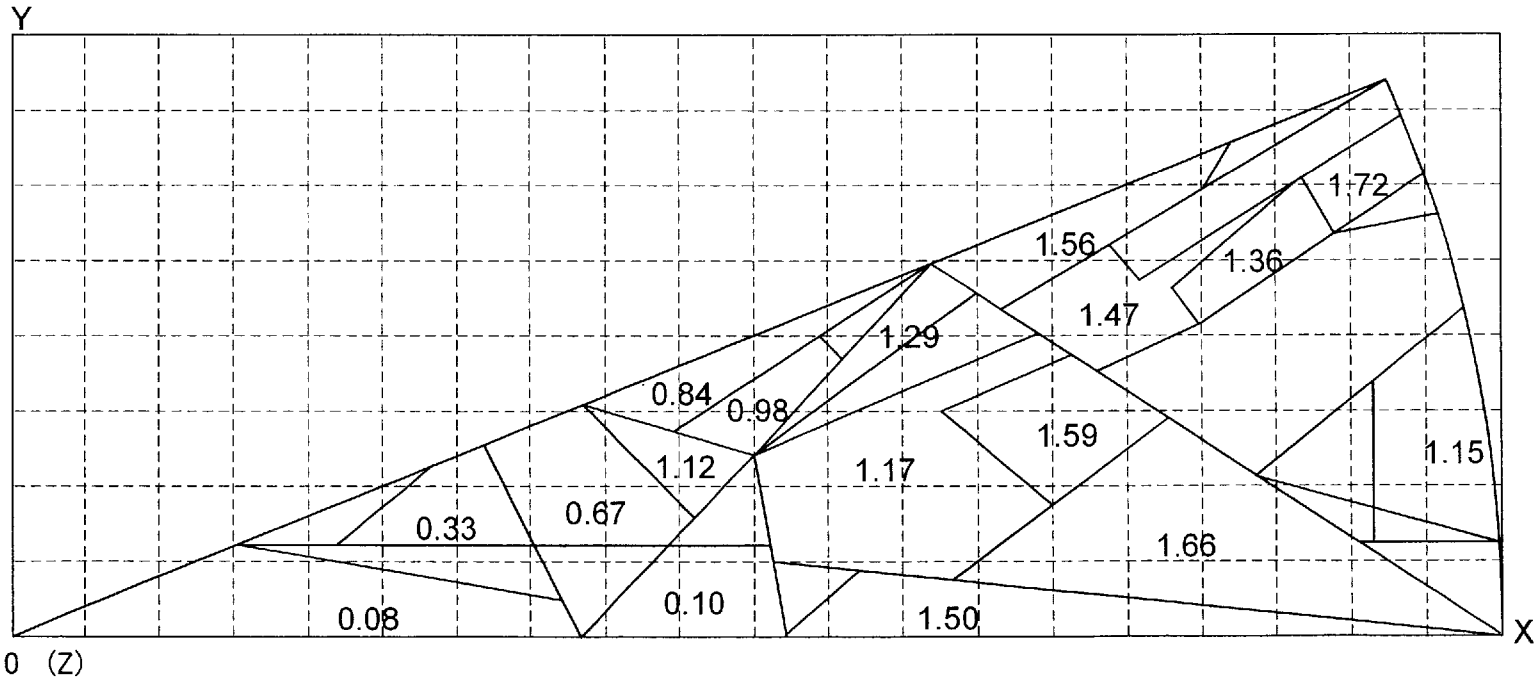
FIG. 24 is still another diagram illustrating the pattern of reflected light angle differences of a diamond according to the invention.

Angle difference patterns of reflected lights of diamonds of a cut design according to the invention having a pavilion angle of 38.5 degrees, a crown angle of 27.9 degrees, a table diameter ratio of 0.5 and a Gd value of 0.33 or 0.16 are shown in FIGS. 22 and 23, respectively. The angle difference patterns of reflected lights of another diamond of the same cut design of which the table diameter ratio is reduced to 0.38 and the Gd value is 0.16 is shown in FIG. 24. As a comparative example, the angle difference pattern of reflected lights of a diamond of a conventional cut having a pavilion angle of 40.75 degrees, a crown angle 34.5 degrees, a table facet diameter ratio of 0.53 and a Gd value of 0.314 is shown in FIG. 25.

Figure 25:
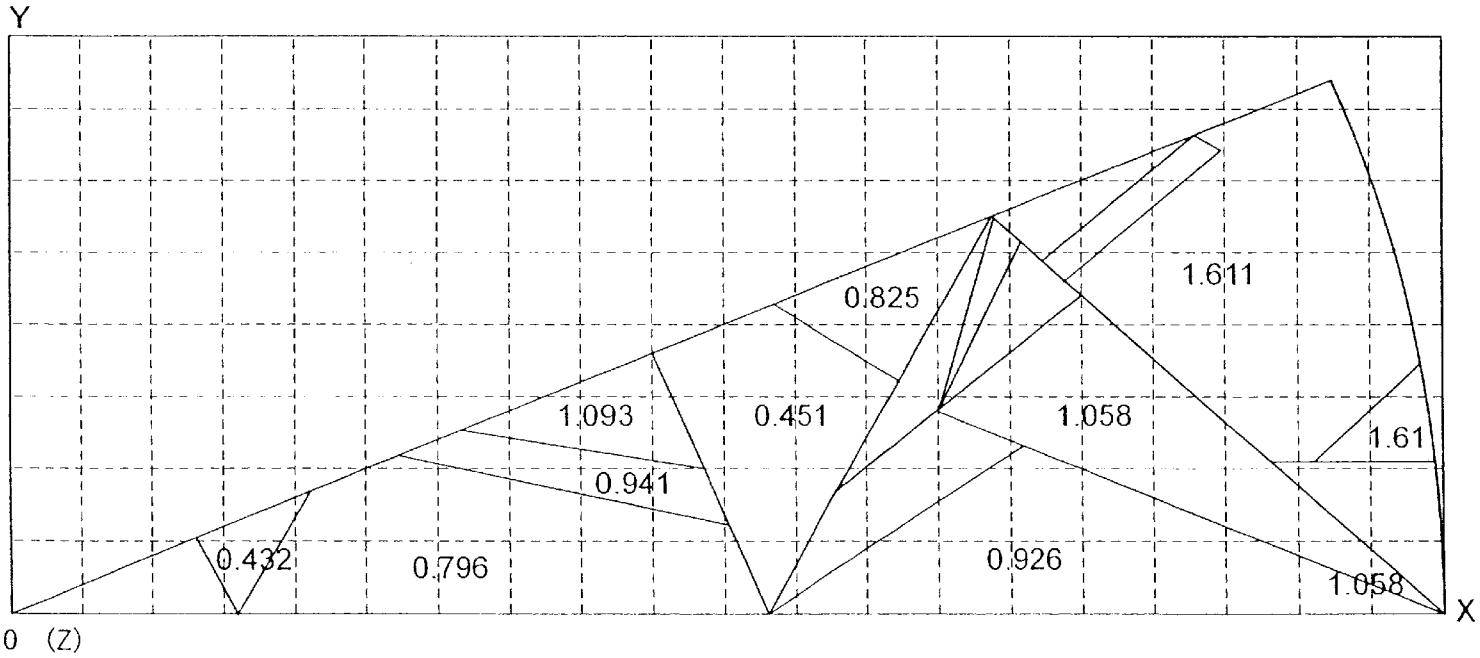
FIG. 25 PRIOR ART
FIG. 25 is a diagram illustrating the pattern of reflected light angle differences of a diamond according to the prior art.

The angle difference patterns of the present invention shown in FIGS. 22 through 24 are greater than the angle difference pattern of reflected lights of a diamond of a conventional cut design (shown in FIG. 25). This makes the diamond look colored. Fine blue patterns are seen on main facets and upper girdle facets of the crown part as reflected lights are colored in addition to the finer optical patterns.

Making focal angles identical according to the present invention can enhance brilliancy and scintillation of ruby, sapphire, zirconia and alexandrite as well. Ruby and sapphire manifest characteristic colors as they are, but their colors can be intensified to make the gems look even more beautiful.

Whereas the advantages of the invention have so far been described with reference to diamonds cut to have 58 facets each, it should be obvious to persons skilled in the art that, if the design involves identical trifocal angles or the pavilion angle and the crown angle are within the coverage of the invention, the invention is not limited to cuts having 58 facets but can as well be applied to other shapes including round brilliant cuts, oval shape, emerald shape, pear shape and trilliant shape.

As hitherto described in detail, a cut design of diamonds for ornamental use according to the present invention not only provides more powerful reflected lights as a whole but also, by virtue of a greater quantity and proportion of emitted lights in specific directions, brilliancy and scintillation in those directions are enhanced, resulting in more significant twinkling brightness.

Also, as there is a large quantity of lights emitted from crown facets, the table facet is reduced in size to increase the area of crown facets, further contributing to enhanced brilliancy and scintillation.

Furthermore, lights are separated into their spectral components within the diamond to cause blue lights to be powerfully emitted from crown facets and thereby to make the diamond itself blue-colored. It is also possible to cause a spectrum from red to blue appear in reflected lights.

What is claimed is:

1. A cut diamond comprising a crown having a substantially frustum shape above a girdle and a substantially conic pavilion below the girdle, the crown having a table facet on a top of the crown and crown facets on the cut diamond outer surface, the crown facets including crown main facets, star facets between the circumference of the table facet and the crown main facets, and upper girdle facets between the girdle and the crown main facets, and the pavilion having pavilion facets on the cut diamond outer surface, the pavilion facets including pavilion main facets and lower girgle facets between the girdle and the pavilion main facets, wherein:

a pavilion angle (p) between the pavilion main facets and a the girdle section is an angle that falls between or is equal to 45 degrees and 37.5 degrees and a crown angle (c) between the crown main facets and the girdle is an angle in angular degrees that satisfies the following condition:

$$-3.5\times p+163.6\geqq c\geqq -3.8333\times p+174.232.$$

2. The cut diamond for ornamental use according to claim 1, wherein the girdle has a diameter and the table facet has a diameter and a ratio of the table facet diameter to the girdle diameter is between or equal to 0.60 and 0.33.

3. The cut diamond for ornamental use according to claim 2, wherein the ratio of the table facet diameter to the girdle diameter is between or equal to 0.55 and 0.38.

4. The cut diamond for ornamental use according to claim 1, wherein:

the pavilion angle (p) and the crown angle (c) are angles within an angular degree range satisfying the following conditions:

$$-3.75427\times p+172.8166\geqq c\geqq -3.74167\times p+171.4883.$$

5. The cut diamond for ornamental use according to claim 4, wherein the pavilion angle (p) in angular degrees and the crown angle (c) in angular degrees are in the following relationship to each other:

$$-3.7239\times p+171.4315\geqq c\geqq -3.74167\times p+171.4883.$$

6. The cut diamond for ornamental use according to claim 5, wherein the girdle has a diameter and the table facet has a diameter and a ratio of the table facet diameter to a girdle diameter is between or equal to 0.60 and 0.33.

7. The cut diamond for ornamental use according to claim 6, wherein the pavilion angle (p) is an angle that falls between or is equal to 40 degrees and 37.5 degrees.

8. The cut diamond for ornamental use according to claim 7, wherein said pavilion has a culet apex; the lower girdle facets each has a culet side apex; the pavilion main facets each has a girdle side apex;

a projection is defined by a distance from a diamond central axis to one of the culet side apexes of the lower girdle facets toward a plane passing the girdle side apex of the pavilion main facets and the central axis of the diamond; and a ratio of the projection to the girdle radius is not more than 0.3.

9. The cut diamond for ornamental use according to claim 8, wherein the ratio of the projection to the girdle radius is not more than 0.25.

10. The cut diamond for ornamental use according to claim 6, wherein the ratio of the table facet diameter to the girdle diameter is between or equal to 0.55 and 0.38.

11. The cut diamond for ornamental use according to claim 10, wherein the pavilion angle (p) is an angle that falls between or is equal to 40 degrees and 37.5 degrees.

12. A cut diamond for ornamental use having a crown part of a substantially frustum shape with crown facets on the cut diamond outer surface, a substantially conic pavilion with pavilion facets on the cut diamond outer surface below the crown, a girdle at the interface between said crown and said pavilion and a table facet above said crown part;

said pavilion facets including eight pavilion main facets with a pavilion angle from the pavilion main facet to said girdle and lower girdle facets between the girdle and the pavilion main facets; and said crown facets including eight crown main facets with a crown angle from the crown main facets to the girdle, star facets between the circumference of the table facet and the crown main facets and upper girdle facets between the girdle and the crown main facets;

wherein;

the pavilion angle (p) is an angle that falls between or is equal to 45 degrees and 37.5 degrees, and a crown angle (c) is an angle in angular degrees that satisfies the following condition:

$$-3.5\times p+163.6\geqq c\geqq -3.8333\times p+174.232;$$

wherein angles between an incident light and an emitted light are substantially equal to each other among light coming in crown facets and emitted from the crown facets, light coming in the table facet and emitted from the crown facets, and light coming in the crown facets and emitted from the table facet.

13. The cut diamond for ornamental use according to claim 12, wherein:

the pavilion angle (p) is an angle in angular degrees and the crown angle (c) is an angle in angular degrees that satisfy the following condition:

$$-3.75427\times p+172.8166\geqq c\geqq -3.74167\times p+171.4883.$$

14. The cut diamond for ornamental use according to claim 13, wherein:

the pavilion angle (p) is an angle in angular degrees and the crown angle (c) in an angle in angular degrees that satisfy the following condition:

$$-3.7239\times p+171.4315\geqq c\geqq -3.74167\times p+171.4883.$$

15. The cut diamond for ornamental use according to claim 14, wherein the pavilion angle (p) is an angle that falls between or is equal to 40 degrees and 37.5 degrees.

16. The cut diamond for ornamental use according to claim 15, wherein the table facet has a diameter and the girdle has a diameter and a ratio of the table facet diameter to the girdle diameter is between 0.60 and 0.33.

17. The cut diamond for ornamental use according to claim 16, wherein said pavilion has a cultex apex;

the lower girdle facets each has a culet side apex the pavilion main facets each has a girdle side apex;

a projection is defined by a distance from a diamond central axis to one of the culet side apexes of lower girdle facets toward a plane passing a girdle side apex of the pavilion main facets and the central axis of the diamond; and a ratio of the projection to the girdle radius is not more than 0.3.

18. The cut diamond for ornamental use according to claim 17, wherein the ratio of the projection to the girdle radius has a value not more than 0.25.

19. The cut diamond for ornamental use according to claim 16, wherein the ratio of the table facet diameter to the girdle diameter is between 0.55 and 0.38.

20. A cut diamond comprising a crown having a substantially frustum shape above a girdle and a substantially conic pavilion below the girdle, the crown having a table facet on a top of the crown and crown facets on the cut diamond outer surface, the crown facet including crown main facets, star facets between the circumference of the table facet and the crown main facets, and upper girdle facets between the girdle and the crown main facets, and the pavilion having pavilion facets on the cut diamond outer surface, the pavilion facets including pavilion main facets and lower girdle facets between the girdle and the pavilion main facets, wherein:

a pavilion angle (p) is between the pavilion main facets and the girdle is an angle that falls between or is equal to 45 degrees and 37.5 degrees and a crown angle (c) between the crown main facets and the girdle is an angle cooperating with the pavilion angle such that the crown angle light coming in the crown facets and emitted from the crown facets, light coming in the table facet and emitted from the crown facets, and light coming in the crown facets and emitted from the table facet are simultaneously observed when viewed from above, wherein the crown angle is an angle in angular degrees that satisfies the following condition:

$$-3.5\times p+1.63.6\geqq c\geqq -3.8333\times p+174.232.$$

21. A cut diamond for ornamental use comprising a crown having a substantially frustum shape above a girdle and a substantially conic pavilion below the girdle, the crown having a table facet on the top of the crown and crown facets on the cut diamond outer surface, the crown facets including crown main facets, star facets between the circumference of the table facet and the crown main facets, and upper girdle facets between the girdle and the crown main facets, and the pavilion having pavilion facets on the cut diamond outer surface, the pavilion facets including pavilion main facets and lower girdle facets between the girdle and the pavilion main facets, wherein:

a pavilion angle (p) between the pavilion main facets and the girdle is an angle that falls between or is equal to 45 degrees and 37.5 degrees and a crown angle (c) between the crown main facets and the girdle is an angle cooperating with the pavilion angle such that the crown angle light coming in the crown facets and emitted from the crown facets, light coming in the table facet and emitted from the crown facets, and light coming in the crown facets and emitted from the table facet are simultaneously observed when viewed from above, and wherein:

the pavilion angle (p) and the crown angle (c) are angles within an angular degree range satisfying the following condition:

$$-3.75427\times p+172.8166\geqq c\geqq -3.74167\times p+1.71.4883.$$

22. The cut diamond for ornamental use according to claim 21, wherein the pavilion angle (p) in angular degrees and the crown angle (c) in angular degrees are in the following relationship to each other:

$$-3.7239\times p+171.4315\geqq c\geqq -3.74167\times p+171.4883.$$

23. The cut diamond for ornamental use according to claim 22, wherein the girdle has a diameter and the table facet has a diameter and a ratio of the table facet diameter to a girdle has a diameter is between or equal to 0.60 and 0.33.

24. The cut diamond for ornamental use according to claim 23, wherein the pavilion angle (p) is an angle that falls between or is equal to 40 degrees and 37.5 degrees.

25. The cut diamond for ornamental use according to claim 24, wherein said pavilion has a culet apex; the lower girdle facets each has a culet side apex; the pavilion main facets each has a girdle side apex;

a projection is defined by a distance from a diamond central axis to one of the culet side apexes of the lower girdle facets toward a plane passing the girdle side apex of the pavilion main facets and the central axis of the diamond; and a ratio of the projection to the girdle radius is not more than 0.3.

26. The cut diamond for ornamental use according to claim 25, wherein the ratio of the projection to the girdle radius is not more than 0.25.

27. The cut diamond for ornamental use according to claim 23, wherein the ratio of the table facet diameter to the girdle diameter is between or equal to 0.55 and 0.38.

28. The cut diamond for ornamental use according to claim 27, wherein the pavilion angle (p) is an angle that falls between or is equal to 40 degrees and 3.75 degrees.

* * * * *